US009449564B2

(12) United States Patent
Kimura

(10) Patent No.: US 9,449,564 B2
(45) Date of Patent: Sep. 20, 2016

(54) CONTROLLER, HOLD-TYPE DISPLAY DEVICE, ELECTRONIC APPARATUS, AND SIGNAL ADJUSTING METHOD FOR HOLD-TYPE DISPLAY DEVICE

(71) Applicant: NLT Technologies, Ltd., Kawasaki (JP)

(72) Inventor: Hiroaki Kimura, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 200 days.

(21) Appl. No.: 13/873,321

(22) Filed: Apr. 30, 2013

(65) Prior Publication Data

US 2013/0307880 A1 Nov. 21, 2013

Related U.S. Application Data

(63) Continuation of application No. 12/421,214, filed on Apr. 9, 2009, now Pat. No. 8,451,299.

(30) Foreign Application Priority Data

Apr. 16, 2008 (JP) ..... 2008-107328

(51) Int. Cl.
*G09G 5/10* (2006.01)
*G09G 3/36* (2006.01)
(Continued)

(52) U.S. Cl.
CPC ..... *G09G 3/3607* (2013.01); *G09G 3/2003* (2013.01); *G09G 3/2025* (2013.01);
(Continued)

(58) Field of Classification Search
CPC . G09G 3/3607; G09G 3/2081; G09G 3/2003
USPC ..... 345/88, 89, 690–697
See application file for complete search history.

(56) References Cited

U.S. PATENT DOCUMENTS

2005/0184944 A1 8/2005 Miyata et al.
2008/0068359 A1 3/2008 Yoshida et al.
2008/0238848 A1* 10/2008 Oishi et al. ..... 345/88

FOREIGN PATENT DOCUMENTS

CN 1551707 A 12/2004
CN 1822086 A 8/2006
(Continued)

OTHER PUBLICATIONS

Chinese Office Action dated Feb. 16, 2012 issued in Chinese Application No. 200910134284.2.
(Continued)

*Primary Examiner* — Dennis Joseph
(74) *Attorney, Agent, or Firm* — Sughrue Mion, PLLC

(57) ABSTRACT

To provide a hold-type display device having a fine luminance efficiency while suppressing generation of motion blur. A controller according to the invention adjusts a signal outputted to a hold-type image display panel, which includes: a double-speed drive converting part which divides one frame of an inputted video signal to a plurality of sub-frames; a color converting part which converts a video signal of three primary colors including the plurality of sub-frames to a video signal of four or more colors including the three primary colors and a compound color; and a sub-frame converting part which converts, the video signal converted by the color converting part, to a signal having a plurality of different gradations whose average luminance value becomes equivalent to luminance of the video signal converted by the color converting part, and takes each of the plurality of gradations as each of gradations of the plurality of sub-frames.

2 Claims, 20 Drawing Sheets

(51) Int. Cl.
*G09G 3/20* (2006.01)
*G09G 5/02* (2006.01)

(52) U.S. Cl.
CPC ..... *G09G3/2081* (2013.01); *G09G 3/3611* (2013.01); *G09G 5/02* (2013.01); *G09G 2300/0452* (2013.01); *G09G 2320/0261* (2013.01); *G09G 2320/0271* (2013.01); *G09G 2340/06* (2013.01)

(56) References Cited

FOREIGN PATENT DOCUMENTS

| | | | |
|---|---|---|---|
| JP | 2001-42282 | A | 2/2001 |
| JP | 2002-23707 | A | 1/2002 |
| JP | 2007-133051 | A | 5/2007 |
| JP | 2007-206560 | A | 8/2007 |
| JP | 2008-009391 | A | 1/2008 |
| JP | 208-065167 | A | 3/2008 |
| JP | 2008-096548 | A | 4/2008 |
| WO | 03/032288 | WO | 4/2003 |

OTHER PUBLICATIONS

Japanese Office Action issued Aug. 20, 2012 in corresponding Japanese Patent Application No. 2008- 107328.

Office Action issued Sep. 19, 2012 in parent U.S. Appl. No. 12/421,214.

Office Action issued Apr. 18, 2012 in parent U.S. Appl. No. 12/421,214.

Notice of Allowance issued Feb. 6, 2013 in U.S. Parent U.S. Appl. No. 12/421,214.

* cited by examiner

FIG. 5

24a,24b 51 52a 52b

| INPUT GRADATION | FIRST SUB-FRAME OUTPUT GRADATION | SECOND SUB-FRAME OUTPUT GRADATION |
|---|---|---|
| 0 | 0 | 0 |
| 1 | 2 | 0 |
| 2 | 4 | 0 |
| 3 | 6 | 0 |
| 4 | 9 | 0 |
| 5 | 11 | 0 |
| : | : | : |
| : | : | : |
| : | : | : |
| 249 | 255 | 241 |
| 250 | 255 | 243 |
| 251 | 255 | 246 |
| 252 | 255 | 248 |
| 253 | 255 | 251 |
| 254 | 255 | 253 |
| 255 | 255 | 255 |

NORMAL DRIVE

BLACK INSERTION DRIVE

TIME-DIVISION DRIVE

CONTROLLER, HOLD-TYPE DISPLAY DEVICE, ELECTRONIC APPARATUS, AND SIGNAL ADJUSTING METHOD FOR HOLD-TYPE DISPLAY DEVICE

CROSS-REFERENCE TO RELATED APPLICATION

This application is a Continuation Application of U.S. application Ser. No. 12/421,214 filed Apr. 9, 2009, which claims priority from Japanese Patent Application No. 2008-107328 filed Apr. 16, 2008, the disclosures of which are incorporated herein by reference in their entirety.

BACKGROUND OF THE INVENTION

1. Field of the Invention

The present invention relates to a hold-type display device such as a liquid crystal display device. More specifically, the present invention relates to suppression of motion blur generated in such display device.

2. Description of the Related Art

FIG. 19 is a time chart showing changes in relative luminance of signals inputted to a hold-type display device such as a liquid crystal display device of a related technique with respect to the time base. FIG. 19(*a*1) and FIG. 19(*a*2) show chronological changes of the relative luminance in a case of normal drive, FIG. 19(*b*1) and FIG. 19(*b*2) show a case of black insertion drive depicted in Japanese Unexamined Patent Publication 2001-042282 (Patent Document 1), and FIG. 19(*c*1) and FIG. 19(*c*2) show a case of time-division drive depicted in Japanese Unexamined Patent Publication 2002-023707 (Patent Document 2). FIG. 19(*a*1) shows the case of the normal drive where the gradation of an input signal is small, while FIG. 19(*a*2) shows the case of the normal drive where the gradation of the input signal is large. Similarly, FIG. 19(*b*1) and FIG. 19(*b*2) as well as FIG. 19(*c*1) and FIG. 19(*c*2) respectively show the cases where the gradation of the input signal is small, and the cases where the gradation is large.

In the cases of the normal drive shown in FIG. 19(*a*1) and FIG. 19(*a*2), the relative luminance does not change with respect to the time base. The response time for the change of the input signal in the hold-type display device is longer than the response time of a cathode-ray tube display device, a plasma display device, and the like. In particular, due to the viscosity of the liquid crystal and the layer thickness, the change in the alignment of the liquid crystal in the liquid crystal display device is delayed compared to the change in the input signals due to its operational principle. Therefore, especially in a moving picture where the change in the input signals is large, a displayed screen may have an afterimage. This phenomenon is called a moving picture tailing (referred simply as "tailing"), a motion blur, or the like.

The black insertion drive of Patent Document 1 shown in FIG. 19(*b*1) and FIG. 19(*b*2) is proposed to suppress the motion blur. With this driving mode, the time base is divided into video sub-frames 301 and black sub-frames 302 in a prescribed proportion, and an inputted signal is displayed as it is in the video sub-frames 301, while a black screen with luminance of 0 is displayed in the black sub-frames 302. This action is the same for both of the case where the gradation of the input signals is small and the case where it is large.

This drive is a spurious impulse drive, so that it is possible to suppress generation of motion blur. However, luminance 303 (shown with alternate long and short dash lines of horizontal direction) recognized by human beings is the average value of the video sub-frames 301 and the black sub-frames 302, so that the luminance efficiency is reduced to half. Thus, it is necessary to increase the luminance of a backlight for preventing a decrease in the luminance, which results in inducing an increase in the cost and power consumption.

The time-division drive of Patent Document 2 shown in FIG. 19(*c*1) and FIG. 19(*c*2) is proposed to suppress the motion blur and to improve the luminance efficiency at the same time. With this driving mode, a video signal is double-speed converted to divide one frame to two sub-frames 304 and 305. In the case of FIG. 19(*c*1) where the gradation of the input signal is small, the gradation of one of the sub-frames, 305, is set to be close to the minimum value, and the gradation of the other sub-frame, 304, is changed.

In the case of FIG. 19(*c*2) where the gradation of the input signal is large, the gradation of one of the sub-frames, 305, is changed, and the gradation of the other sub-frame, 304, is set to be close to the maximum value. Luminance 306 (shown with alternate long and short dash lines of horizontal direction) recognized by human beings is the average value of the sub-frames 304 and 305. Thus, the gradation of the sub-frames is so set that the average luminance becomes equivalent to the gradation of the original input signal.

More specifically, it is a method which: provides an attenuation signal generating circuit which divides one frame into a plurality of sub-frames, and performs division with an attenuation variable which changes depending on the extent of the luminance of the input video signals; displays the luminance signal of before the division in a preceding sub-frame; and displays the luminance signal of after the division in a following sub-frame.

With this method, it is possible to suppress generation of the motion blur on the low-gradation side without deteriorating the luminance efficiency, by setting the attenuation variable in such a manner that the display of a following sub-frame becomes the maximum when the luminance of the input video signal is the maximum, and setting the attenuation variable in such a manner that the display of a following sub-frame becomes the minimum when the luminance of the input video signal is small.

Other than Patent Document 1 and Patent Document 2 described above, there are following technical documents which are related to suppression of motion blur generated in a hold-type display device. Domestic Re-publication of International Application WO 2003/032288 (Patent Document 3) discloses a technique which sets a period for displaying a black sub-frame in black insertion drive based on move amount of image signals. Japanese Unexamined Patent Publication 2007-133051 (Patent Document 4) discloses a technique which, in time-division drive, decreases the gradation of the sub-frame having the larger gradation to keep luminance difference between the sub-frames.

FIG. 20 shows graphs showing corresponding relations between input signals and relative luminance in each of the modes shown in FIG. 19. FIG. 20(*a*) shows a case of normal drive, FIG. 20(*b*) shows a case of black insertion drive, and FIG. 20(*c*) shows a case of time-division drive, respectively. In all the graphs, the lateral axis is the gradation of an input signal, and the vertical axis is the relative luminance with respect to a white screen. Naturally, there is no change in the relative luminance in the case of the normal drive shown in FIG. 20(*a*). In the case of the black insertion drive shown in FIG. 20(*b*), the relative luminance decreases in accordance with a proportion (1:1 in this case) of time periods where the video sub-frame 301 and the black sub-frame 302 are displayed, respectively.

In the case of the time-division drive shown in FIG. 20(*c*), when the gradation of the input signal is small, one of the sub-frames, 305, comes to have the relative luminance that is close to black display. Therefore, there is an effect of suppressing the generation of the motion blur as in the case of the black insertion drive. In addition, when the gradation of the input signal is large, the other sub-frame, 304, comes to have the luminance close to the maximum display. Therefore, there is also such an effect that the luminance efficiency is not deteriorated.

However, the effect of suppressing the generation of the motion blur is limited to the case where the gradation of the input signal is small. When the gradation of the input signal becomes larger, the effect of suppressing the motion blur becomes insignificant. Therefore, deformation of the moving picture, colored motion blur, and the like generated along with the motion blur are to generate continuously.

Further, while it becomes possible to suppress generation of the motion blur over the whole gradation ranges by having the attenuation variable as a constant and setting the luminance of the following sub-frame to be small, the effect of improving the luminance efficiency is decreased. That is, it is difficult with the above-described time-division drive to achieve both suppression of the motion blur and improvement of the luminance efficiency.

The technique disclosed in Patent Document 3 is a partially improved version of the black insertion drive disclosed in Patent Document 1. Since it is still the black insertion drive, the above-described shortcomings cannot be overcome with that technique. Further, since the technique disclosed in Patent Document 4 is to keep the luminance difference between the sub-frames by decreasing the gradation of the sub-frame having the larger gradation, deterioration in the luminance efficiency cannot be avoided, either. That is, none of Patent Documents 1-4 discloses a technique that is capable of achieving both the suppression of the motion blur and the improvement of the luminance efficiency.

SUMMARY OF THE INVENTION

An exemplary object of the present invention is to provide a controller, a hold-type display device, an electronic apparatus, and a hold-type display device signal adjusting method, which can provide a fine luminance efficiency while suppressing generation of the motion blur in an image display device.

In order to achieve the foregoing exemplary object, the controller according to an exemplary aspect of the invention is a controller for adjusting a signal outputted to a hold-type image display panel. The controller comprises: a video signal converting part having a double-speed drive conversion function which divides one frame of a video signal to a plurality of sub-frames, and a color conversion function which converts a video signal of three primary colors to a video signal of four or more colors including the three primary colors and a compound color; and a sub-frame converting part which converts, the video signal converted by the video signal converting part, to a signal having a plurality of different gradations whose average luminance value becomes equivalent to luminance of the video signal converted by the color converting part, and takes each of the plurality of gradations as each of gradations of the plurality of sub-frames.

In order to achieve the foregoing exemplary object, the hold-type image display device according to another exemplary aspect of the invention comprises: a hold-type image display panel containing four or more colors of sub-pixels including three primary colors and a compound color; a driver circuit for outputting a signal to the hold-type image display panel; and a controller for drive-controlling the driver circuit, wherein the controller is the controller according to one of the aspects of the present invention.

In order to achieve the foregoing exemplary object, the electronic apparatus according to the present invention is an electronic apparatus which comprises a hold-type image display device, wherein the hold-type image display device is the hold-type image display device according to one of the aspects of the present invention.

In order to achieve the foregoing exemplary object, the signal adjusting method according to still another exemplary aspect of the invention is a signal adjusting method for adjusting a signal outputted to a hold-type image display panel of a hold-type display device, which comprises: a double-speed drive converting step which divides one frame of an inputted video signal to a plurality of sub-frames; a color converting step which converts a video signal of three primary colors including the plurality of sub-frames to a video signal of four or more colors including the three primary color and a compound color; and a sub-frame converting part which converts, the video signal converted by the color converting step, to a signal having a plurality of different gradations whose average luminance value becomes equivalent to luminance of the video signal converted by the color converting step, and takes each of the plurality of gradations as each of gradations of the plurality of sub-frames.

In order to achieve the foregoing exemplary object, the signal adjusting method according to still another exemplary aspect of the invention is a signal adjusting method for adjusting a signal outputted to a hold-type image display panel of a hold-type display device, which comprises: a color converting step which converts an inputted video signal of three primary colors to a video signal of four or more colors including the three primary colors and a compound color; a double-speed drive converting step which divides one frame of the video signal of the four or more colors to a plurality of sub-frames; and a sub-frame converting step which converts, the video signal converted by the double-speed drive converting step, to a signal having a plurality of different gradations whose average luminance value becomes equivalent to luminance of the video signal converted by the color converting step, and takes each of the plurality of gradations as each of gradations of the plurality of sub-frames.

BRIEF DESCRIPTION OF THE DRAWINGS

FIG. 5 is a conceptual diagram showing a practical example of a first sub-frame LUT and a second sub-frame LUT shown in FIG. 1;

-FIG. 8 is applied;

DETAILED DESCRIPTION OF THE EXEMPLARY EMBODIMENTS

Hereinafter, exemplary embodiments of the invention will be described in detail by referring to the accompanying drawings.

First Exemplary Embodiment

Figure 1:
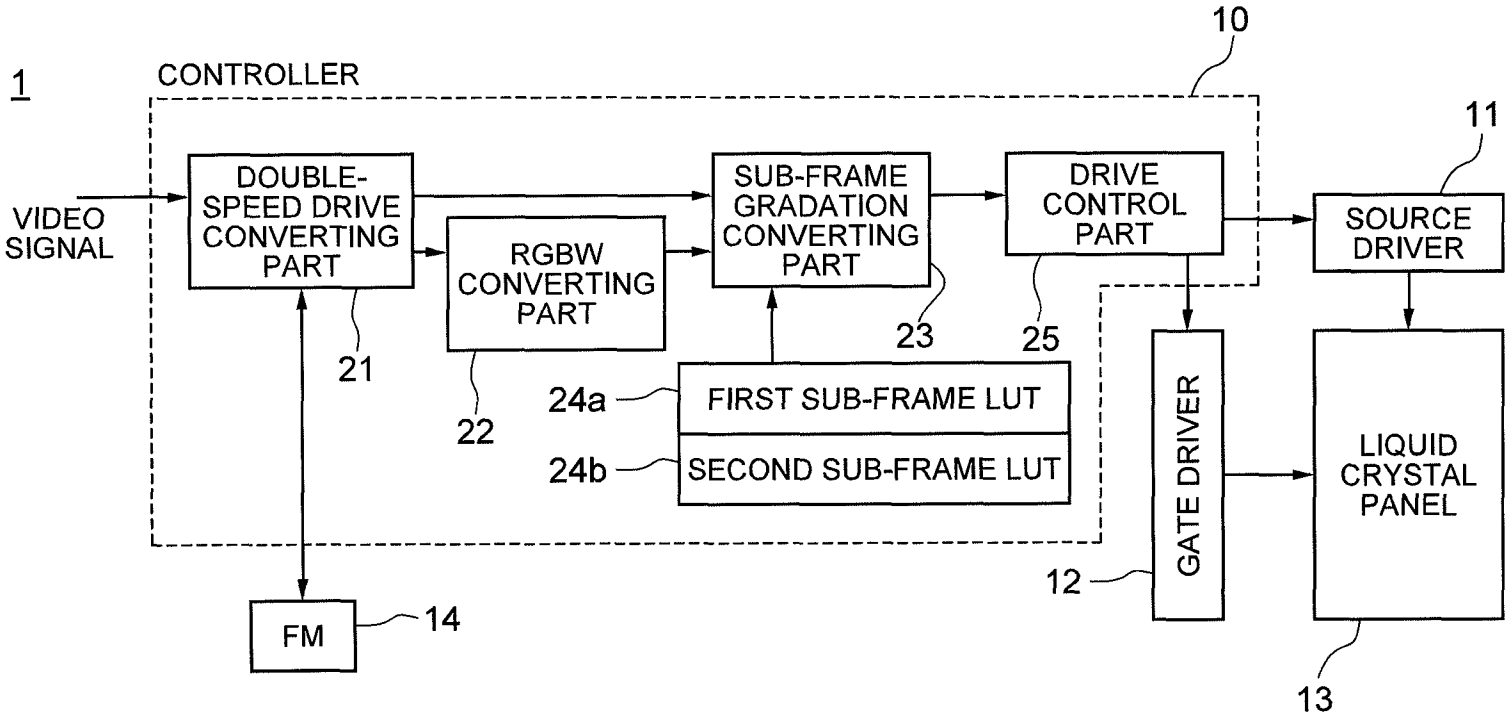
FIG. 1 is a block diagram showing a structure of a liquid crystal display device according to a first exemplary embodiment of the present invention.

FIG. 1 is a block diagram showing a structure of a liquid crystal display device 1 according to a first exemplary embodiment of the present invention. The liquid crystal display device 1 includes a controller 10, a source driver 11, a gate driver 12, a liquid crystal panel 13, and a frame memory (FM) 14. The controller 10 controls the source driver 11 which outputs video signals and the gate drover 12 which outputs scanning signals based on the video signals inputted from outside to display videos on the liquid crystal panel 13. The frame memory 14 will be described later.

The controller 10 includes a double-speed drive converting part 21, an RGBW converting part 22, a sub-frame gradation converting part 23, a first dub-frame LUT (lookup table) 24*a*, a second sub-frame LUT (lookup table) 24*b*, and a drive control part 25.

The double-speed drive converting part 21 uses the frame memory 14 to double the speed of the inputted video signal to repeat the same video signal twice in one frame period so as to convert the video signal to the signals of the first sub-frame and the second sub-frame, and transmits those signals to the RGBW converting part 22 as double-speed video signals. The double-speed drive converting part 21 transmits identification information for discriminating the first sub-frame and identification information for discriminating the second sub-frame to the sub-frame gradation converting part 23 simultaneously.

The RGBW converting part 22 converts the double-speed video signals inputted from the double-speed drive converting part 21 to RGBW, and performs processing to make the maximum gradation of the RGBW small. Then, the RGBW converting part 22 transmits the RGBW to the sub-frame gradation converting part 23. The RGBW referred herein will be described later.

The sub-frame gradation converting part 23 comprises two types of LUTs (lookup tables) such as the first sub-frame LUT 24*a* and the second sub-frame LUT 24*b*. The sub-frame gradation converting part 23 converts the signal of the first sub-frame with the first sub-frame LUT 24*a* to generate a first sub-frame video signal and converts the signal of the second sub-frame with the second sub-frame LUT 24*b* to generate a second sub-frame video signal based on the double-speed video signals processed by the RGBW converting part 22 as well as the first sub-frame identification information and the second sub-frame identification information received from the double-speed drive converting part 21, and transmits each of the sub-frame video signals to the drive control part 25.

The drive control part 25 generates control signals of the source driver 11 and the gate driver 12 from the first and second sub-frame video signals received from the sub-frame gradation converting part 23, and outputs those to each of the drivers 11 and 12.

While the controller 10 is built as hardware, the present invention is not limited to such case. That is, each functional block shown as being included in the controller 10 in FIG. 1 may be achieved by having a microcomputer execute a program built as software. In that case, the frame memory 14 is a RAM of the microcomputer, and the first sub-frame LUT 24*a* and the second sub-frame LUT 24*b* may be considered as data stored inside the microcomputer.

Figure 2:
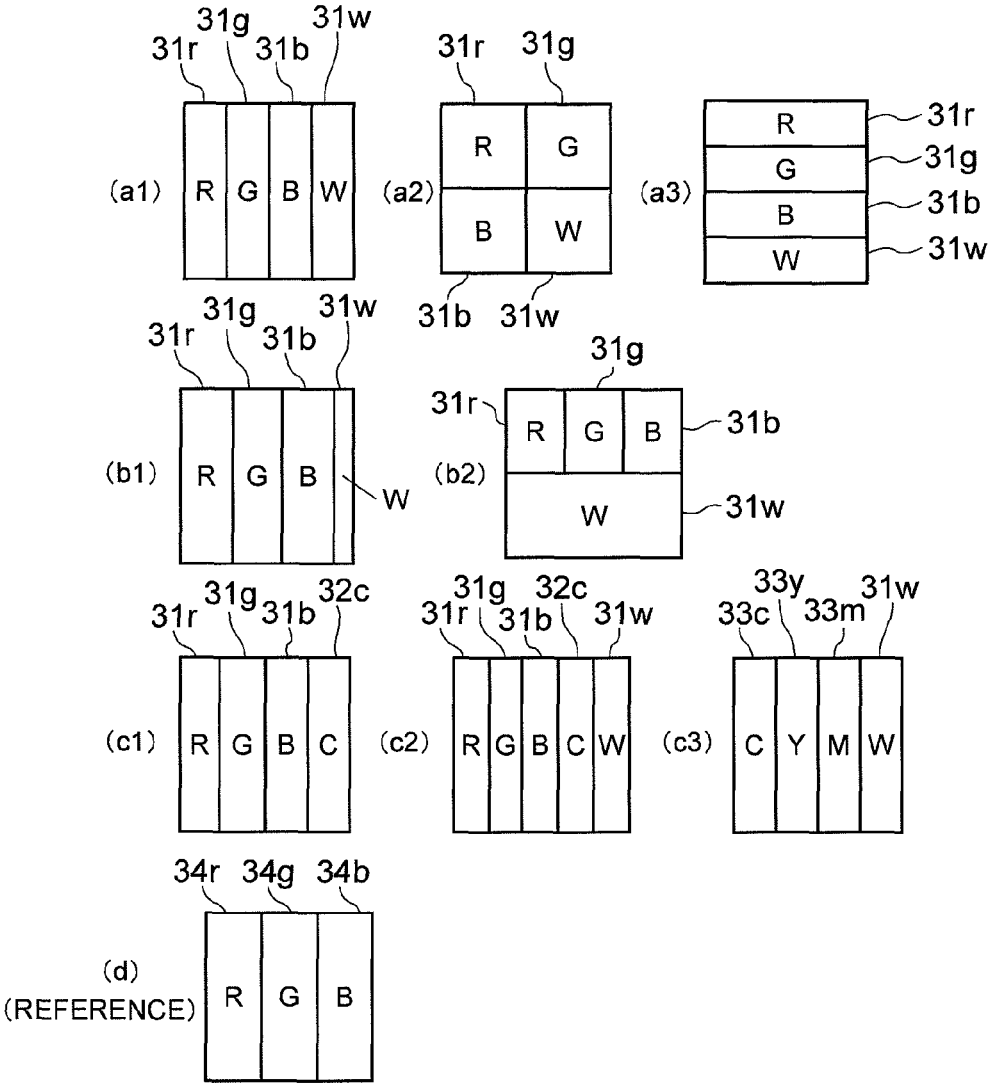
FIG. 2 is a conceptual diagram showing examples of structures of sub-pixels of a liquid crystal panel shown in FIG. 1.

FIG. 2 is a conceptual diagram showing examples of sub-pixels of the liquid crystal panel 13 shown in FIG. 1. The liquid crystal panel 13 has pixels shown in the drawing arranged in matrix. FIG. 2(*a*1)-FIG. 2(*c*3) show examples of an RGBW pixel structure of the exemplary embodiment. FIG. 2(*d*) shows a normal RGBW striped pixel structure for reference. In the RGBW striped pixel structure shown in FIG. 2(*d*), three kinds of RGB sub-pixels 34*r*, 34*g*, and 34*b* are arranged in a vertical-striped form with equivalent area ratios.

"RGBW" is a color structure including the three primary colors (red (R), green (G), blue (B)) and a compound color white (W). In the RGBW pixel structure shown in FIG. 2(*a*1)-FIG. 2(*a*3), four types of RGBW sub-pixels 31*r*, 31*g*, 31*b*, and 31*w* are arranged with equivalent area ratios. The layout thereof is not limited to a vertical striped form as in that of FIG. 2(*a*1). For example, the sub-pixels may be arranged in a lateral striped form as in FIG. 2(*a*2) or in a grid-like form as in FIG. 2(*a*3).

Further, an effect of white (W) can be adjusted by arranging the sub-pixels of three colors 31*r*, 31*g*, and 31*b* in equivalent area ratios, and arranging the sub-pixel 31*w* in an area ratio that is different from the ratios of the sub-pixels 31*r*, 31*g*, and 31*b*, as shown in FIG. 2(*b*1)-FIG. 2(*b*2).

Further, as shown in FIG. 2(*c*1), in a case of having no color layer of the color filter of the panel, for example, the same effect of the present invention can be achieved with the use of a color that is a mixture of the three primary colors, such as cyan (C), yellow (Y), magenta (M), or the like instead of using the sub-pixel 31*w* of white (W) (FIG. 2(*c*1) shows a color structure which contains sub-pixel 32*c* of cyan (C) instead of white (W)).

Further, as shown in FIG. 2(*c*2), it is also possible to employ a color structure which includes the three primary colors, white, and a color other than white (sub-pixel 32*c* of cyan (C) in the drawing). Furthermore, as shown in FIG. 2(*c*3), the sub-pixels 31*r*, 31*g*, and 31*b* of the three primary colors RGB may be replaced with sub-pixels 33*c*, 33*y*, and 33*m* of the colors cyan (C), yellow (Y), and magenta (M), respectively.

Hereinafter, it is assumed that the inputted video signal is of the three primary colors of RGB, and the signal intensities of respective colors are expressed as (R, G, B). The pixel structure of the liquid crystal panel 13 is assumed to be in a form where the four types of RGBW sub-pixels 31*r*, 31*g*, 31*b*, and 31*w* shown in FIG. 2(*a*1)-FIG. 2(*a*3) are arranged in equivalent area ratios.

Figure 3:
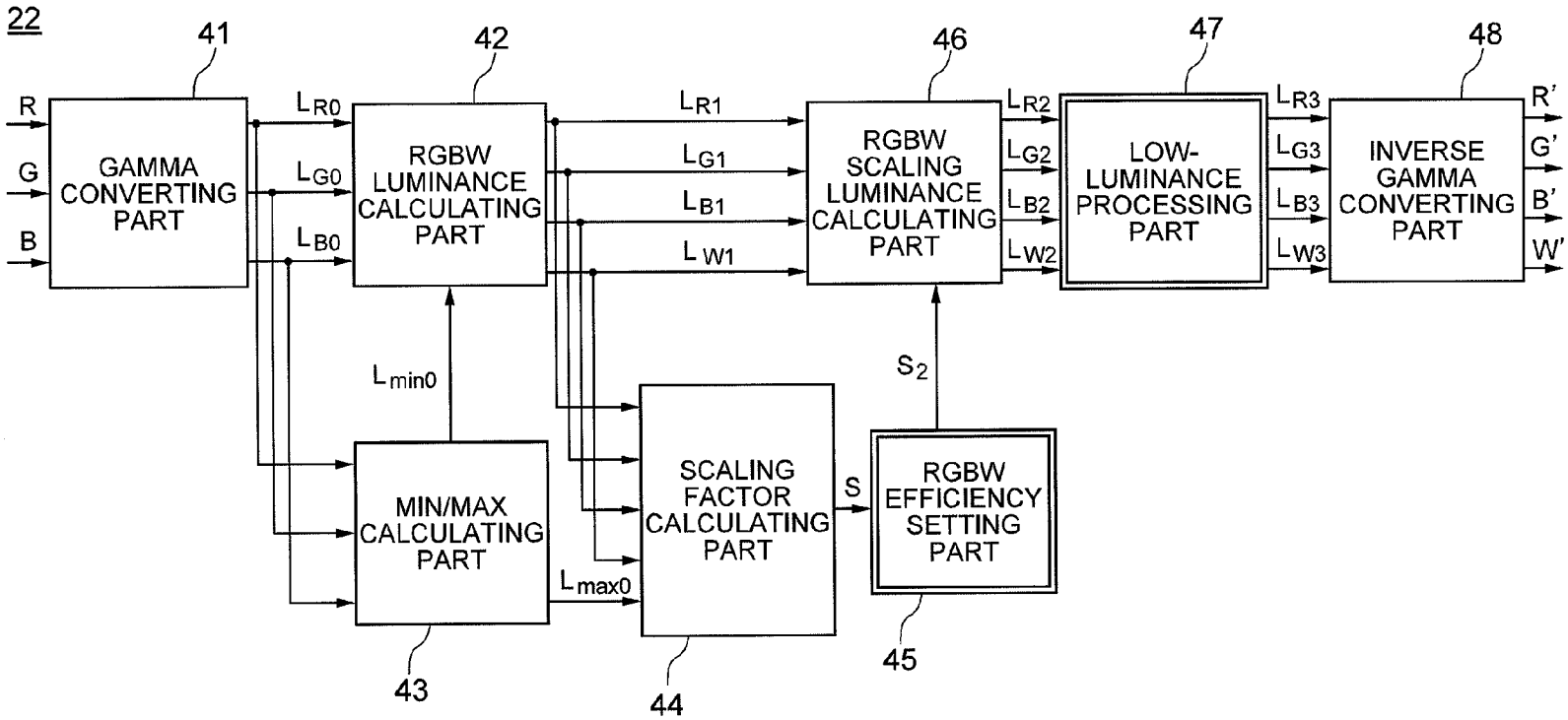
FIG. 3 is a block diagram which more specifically shows a structure of an RGBW converting part shown in FIG. 1.
Figure 4:
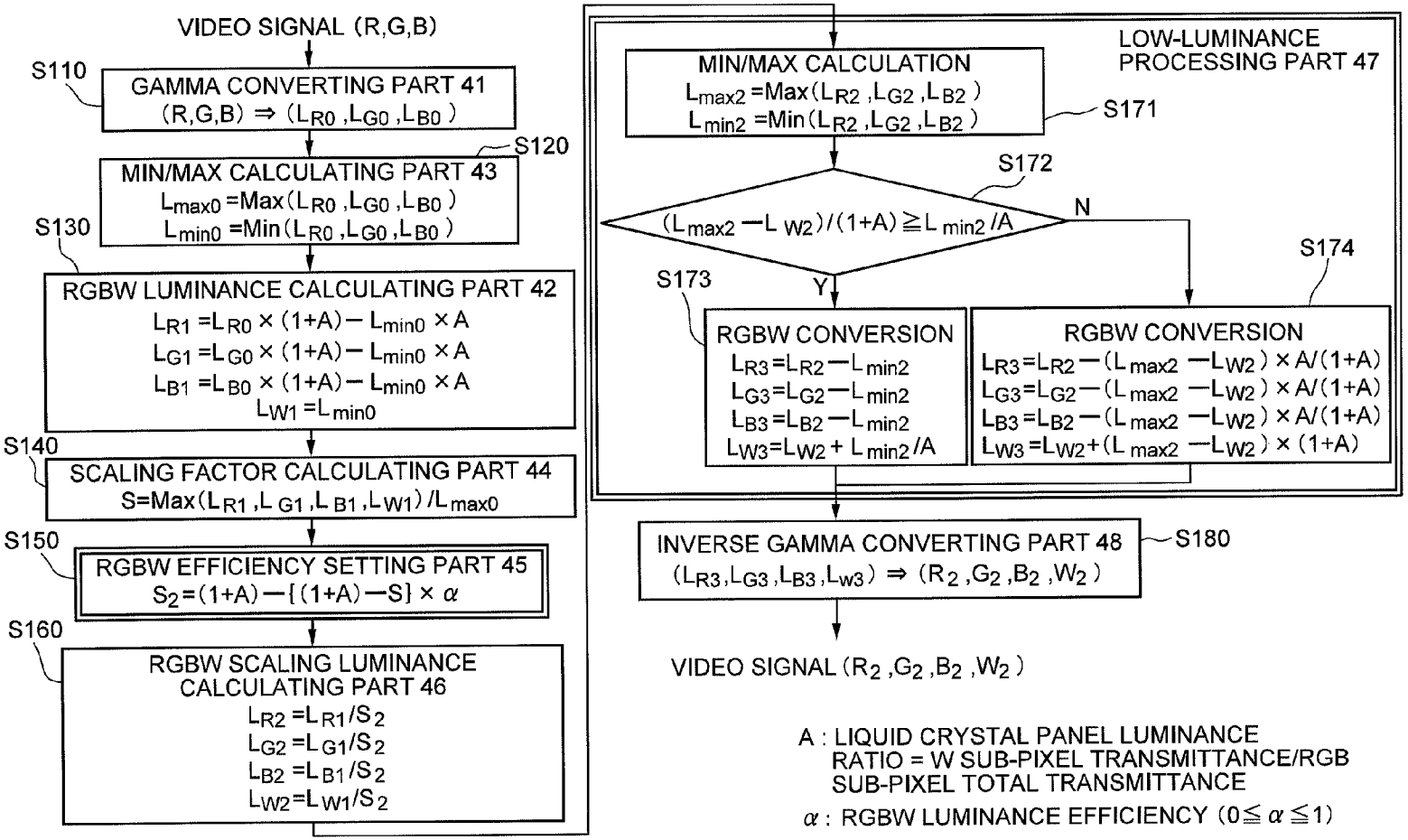
FIG. 4 is a flowchart showing operations of the RGBW converting part shown in FIG. 3.

FIG. 3 is a block diagram which shows a more specific structure of the RGBW converting part 22 shown in FIG. 1. Further, FIG. 4 is a flowchart showing operations of the RGBW converting part 22 shown in FIG. 3. The RGBW converting part 22 includes a gamma converting part 41, an RGBW luminance calculating part 42, a Min/Max calculating part 43, a scaling factor calculating part 44, an RGBW efficiency setting part 45, an RGBW scaling luminance calculating part 46, a low-luminance processing part 47, and an inverse gamma converting part 48.

The gamma converting part 41 converts the inputted video signal (R, G, B) to be in relative luminance ($L_{R0}$, $L_{G0}$, $L_{B0}$) by using Expression 1 (step S110). Here, the resolution of the input signal is defined as N bit, and the gamma constant is defined as γ. The obtained relative luminance is inputted to the RGBW luminance calculating part 42 and the Min/Max calculating part 43.

$$L_{RO} = \left(\frac{R}{2^N - 1}\right)^{\gamma}$$

$$L_{GO} = \left(\frac{G}{2^N - 1}\right)^{\gamma}$$

$$L_{BO} = \left(\frac{B}{2^N - 1}\right)^{\gamma}$$

Expression 1

The Min/Max calculating part 43 calculates the maximum value $L_{max0}$ and the minimum value $L_{min0}$ of the relative luminance inputted from the gamma converting part 41 by using Expression 2 (step S120). The obtained minimum value of the relative luminance is inputted to the RGBW luminance calculating part 42. Further, the maximum value of the relative luminance is inputted to the scaling factor calculating part 44.

$$L_{max0}=\mathrm{Max}(L_{R0},L_{G0},L_{B0})$$

$$L_{min0}=\mathrm{Min}(L_{R0},L_{G0},L_{B0})$$

Expression 2

The RGBW luminance calculating part 42 allots the minimum value $L_{min0}$ of the relative luminance inputted from the Min/Max calculating part 43 to the relative luminance of W, and calculates the relative luminance ($L_{R1}$, $L_{G1}$, $L_{B1}$, $L_{W1}$) of RGBW by using Expression 3 in such a manner that there is no change in the chromaticity (step S130). It is defined here that A=(W sub-pixel transmittance/total transmittance of RGB sub-pixels). The obtained relative luminance of RGBW is inputted to the scaling factor calculating part 44 and the RGBW scaling luminance calculating part 46.

$$L_{R1}=L_{R0}(1+A)-L_{min0}A$$

$$L_{G1}=L_{G0}(1+A)-L_{min0}A$$

$$L_{B1}=L_{B0}(1+A)-L_{min0}A$$

$$L_{W1}=L_{min0}$$

Expression 3

The scaling factor calculating part 44 calculates scaling factor S from the relative luminance of RGBW inputted from the RGBW luminance calculating part 42 by using Expression 4 (step S140). The scaling factor S is a value which shows amplification of the luminance when the input signal (R, G, B) expressed in an RGB color space is converted to an RGBW display color space that is a non-similar color space. The obtained scaling factor S is outputted to the RGBW efficiency setting part 45.

$$S = \frac{\mathrm{Max}(L_{R1}, L_{G1}, L_{B1}, L_{W1})}{L_{max0}}$$

Expression 4

The RGBW efficiency setting part 45 calculates scaling factor $S_2$ from the scaling factor S inputted from the scaling factor calculating part 44 by using Expression 5 (step S150). The scaling factor $S_2$ is a value of the scaling factor that is adjusted with luminance improving efficiency α of RGBW. The value of luminance improving efficiency α can be set arbitrarily between 0-1. The luminance amplification amount is increased as the value of luminance improving efficiency α is set to a larger value, and it is decreased when the value of luminance improving efficiency α is set to a smaller value. Further, "A" is the same as that used in Expression 3. The obtained scaling factor $S_2$ is outputted to the RGBW scaling luminance calculating part 46.

$$S_2=(1+A)-\alpha\{(1+A)-S\} \quad \text{Expression 5}$$

The RGBW scaling luminance calculating part 36 calculates the scaling relative luminance ($L_{R2}$, $L_{G2}$, $L_{B2}$, $L_{W2}$) from the relative luminance of RGBW inputted from the RGBW luminance calculating part 42 and the scaling factor $S_2$ inputted from the RGBW efficiency setting part 45 by using Expression 6 (step S160). Through this conversion, the luminance of the output video signal can be made smaller than the maximum luminance even if all the luminance values of the input signal (R, G, B) are the maximum values. The obtained scaling relative luminance is outputted to the low-luminance processing part 47.

$$L_{R2}=L_{R1}/S_2$$

$$L_{G2}=L_{G1}/S_2$$

$$L_{B2}=L_{B1}/S_2$$

$$L_{W2}=L_{W1}/S_2 \quad \text{Expression 6}$$

Through the processing executed heretofore, the relative luminance of the three colors (R, G, B) of the input signal is converted to the relative luminance of the four colors of RGBW. The low-luminance processing part 47 first calculates the maximum value $L_{max2}$ and the minimum value $L_{min2}$ of the RGB component from the scaling relative luminance inputted from the RGBW scaling luminance calculating part 46 by using Expression 7 (step S171).

$$L_{max2}=\mathrm{Max}(L_{R2},L_{G2},L_{B2})$$

$$L_{min2}=\mathrm{Min}(L_{R2},L_{G2},L_{B2}) \quad \text{Expression 7}$$

Here, the low-luminance processing part 47 judges the magnitudes between a first value and a second value shown in Expression 8, regarding the obtained maximum value and minimum value of the RGB component as well as the W component $L_{W2}$ of the scaling relative luminance (step S172). When the first value in Expression 8 is equal to or larger than the second value, the scaling relative luminance ($L_{R2}$, $L_{G2}$, $L_{B2}$, $L_{W2}$) obtained by performing the low-luminance processing on the maximum value is calculated with Expression 9 (step S173). When the first value of Expression 8 is less than the second value, the scaling relative luminance ($L_{R2}$, $L_{G2}$, $L_{B2}$, $L_{W2}$) to which the low-luminance processing has been done is calculated with Expression 10 (step S174). "A" is the same as those used in Expression 3 and Expression 5.

$$\frac{L_{max2}-L_{W2}}{1+A} \text{ FIRST VALUE} \quad \text{Expression 8}$$

$$\frac{L_{min2}}{A} \text{ SECOND VALUE}$$

$$L_{R3}=L_{R2}-L_{min2} \quad \text{Expression 9}$$

$$L_{G3}=L_{G2}-L_{min2}$$

$$L_{B3}=L_{B2}-L_{min2}$$

$$L_{W3}=L_{W2}+\frac{L_{min2}}{A}$$

$$L_{R3}=L_{R2}-(L_{max2}-L_{W2})\frac{A}{1+A} \quad \text{Expression 10}$$

$$L_{G3}=L_{G2}-(L_{max2}-L_{W2})\frac{A}{1+A}$$

$$L_{B3}=L_{B2}-(L_{max2}-L_{W2})\frac{A}{1+A}$$

$$L_{W3}=L_{W2}+\frac{L_{max2}-L_{W2}}{1+A}$$

This processing is an arithmetic operation which lowers the maximum value by making the RGB component maximum value of the scaling relative luminance and the value of the W component uniform, while minding not to cause a change in the display. With the scaling relative luminance obtained by performing the low-luminance processing on the maximum value by the arithmetic operation, the maximum value of the RGB component and the value of the W component become equivalent, unless one of the components is 0. The obtained low-luminance processed scaling relative luminance is inputted to the inverse gamma converting part 48.

The inverse gamma converting part 48 converts the low-luminance processed scaling relative luminance inputted from the low-luminance processing part 47 to low-gradation processed RGB gradation values ($R_2$, $G_2$, $B_2$, $W_2$) by using Expression 11 (step S180). The obtained low-gradation processed RGB gradation values are inputted to the sub-frame gradation converting part 23. "N" and "γ" are the same as those used in Expression 1.

$$R_2=(2^N-1)L_{R3}^{1/T}$$

$$G_2=(2^N-1)L_{G3}^{1/T}$$

$$B_2=(2^N-1)L_{B3}^{1/T}$$

$$W_2=(2^N-1)L_{W3}^{1/T} \quad \text{Expression 11}$$

As described, the RGBW converting part 22 is capable of converting the inputted video signal (R, G, B) to the video signal (R, G, B, W), and capable of converting the video signal to decrease the maximum gradation of the video signal by the use of the RGBW efficiency setting part 45 and the low-luminance processing part 47.

FIG. 5 is a conceptual diagram showing a practical example of a first sub-frame LUT 24*a* and a second sub-frame LUT 24*b* shown in FIG. 1. FIG. 5 shows corresponding relations regarding values of input gradation 51, first sub-frame output gradation 52*a* obtained by converting the input gradation 51 with the first sub-frame LUT 24*a*, and second-sub-frame output gradation 52*b* obtained by converting the input gradation 51 with the second sub-frame LUT 24*b*.

Figure 6A:
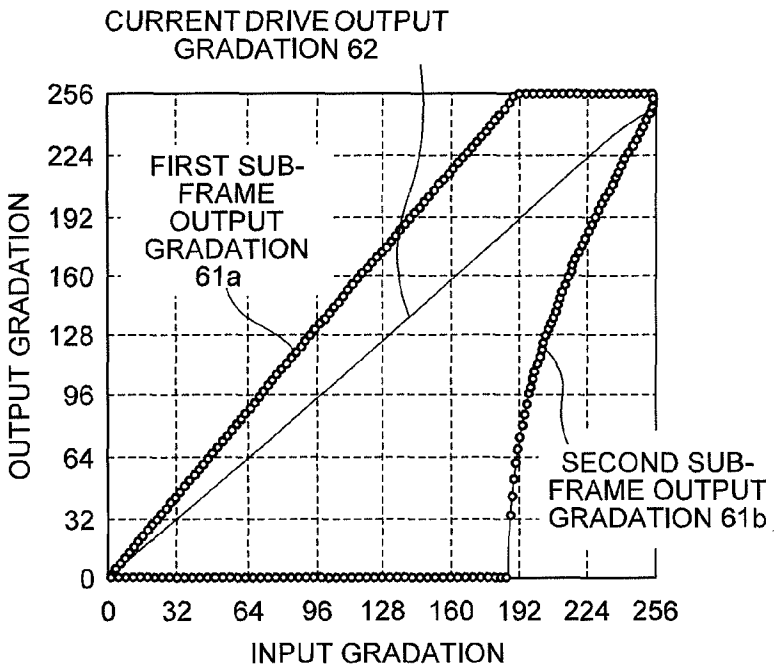
FIG. 6A is a graph of the output gradation property, in which the vertical axis is the first sub-frame output gradation 52*a* and the second sub-frame output gradation 52*b*.
Figure 6B:
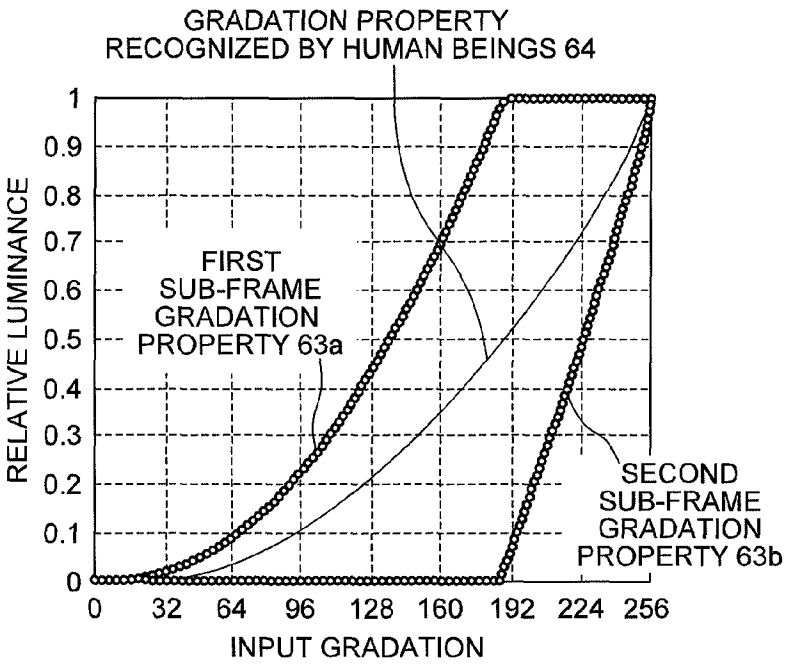
FIG. 6B is a graph of the gradation luminance property, in which the vertical axis is the relative luminance which is the relative value of the luminance recognized by human beings.

FIG. 6 shows graphs which illustrate a gradation luminance property and an output gradation property of the first sub-frame LUT 24*a* and the second sub-frame LUT 24*b* shown in FIG. 5. FIG. 6(*a*) is a graph of the output gradation property, in which the lateral axis is the gradation 51, and the vertical axis is the first sub-frame output gradation 52*a* and the second sub-frame output gradation 52*b*. FIG. 6(*b*) is a graph of the gradation luminance property, in which the lateral axis is the input gradation 51, and the vertical axis is the relative luminance which is the relative value of the luminance recognized by human beings.

In FIG. 6(*a*), the value of the first sub-frame output gradation 52*a* corresponding to the input gradation 52 is shown with a curve 61*a*, and the value of the second sub-frame output gradation 52*b* is shown with a curve 61*b*, respectively. A straight line 62 shows output gradations of current drive, and it is an average value of the curves 61*a* and 61*b*. In this exemplary embodiment, the gradation of RGBW converted to be smaller than the gradation of the input video signal from the RGBW converting part 22 is inputted to the sub-frame gradation converting part 23.

The sub-frame gradation converting part 23 sets the gradation of one of the sub-frames to be close to the minimum value and changes the other sub-frame when the gradation of the input signal is small, while changing the gradation of one of the sub-frames and setting the gradation of the other sub-frame to be close to the maximum value so that the average luminance obtained by leveling the luminance of each input gradation of each sub-frame becomes equivalent to that of the input video data.

When the input gradation 51 is larger than a prescribed value, e.g., when it is 186 or larger in FIG. 6(*a*), the luminance of the first sub-frame becomes the maximum value. Therefore, the luminance of the second-sub frame is increased in order to increase the average luminance of the first and the second sub-frames by following the input video data.

In the relative luminance shown in FIG. 6(*b*), conversion of the input gradation 51 to the first sub-frame output gradation 52*a* and the second sub-frame output gradation 52*b* is performed in such a manner that the first sub-frame matches the first sub-frame gradation property shown with a curve 63*a* and the second sub-frame matches the second sub-frame gradation property shown with a curve 63*b*. A curve 64 is the average luminance of the curves 63*a* and 63*b*, and it is a curve of the gradation property recognized by human beings.

Note here that the motion blur can be reduced more as the luminance of the second sub-frame becomes smaller and the range of the values of the input gradation 51 with which the luminance of the second sub-frame becomes smaller becomes wider. Thus, it is preferable for the luminance of the second sub-frame to be 0, or may be a little higher than 0. The minimum value of the input gradation 51 with which the luminance of the second sub-frame becomes 0 is 0, and the maximum value is a value with which the luminance recognized by human beings becomes equivalent to that of the input video data when the luminance of the first sub-frame is the maximum value and the luminance of the second sub-frame is 0. However, a gradation that is little smaller than that may be taken as the maximum value as well.

Next, specific values will be used for providing explanations. It is assumed that the gradations of the video signal (R, G, B) inputted to the controller are (230, 190, 210). Further, it is assumed that A=1.3, $\alpha$=0.75, the resolution N of the input signal is 8 (bits), and $\gamma$=2.2. In this exemplary embodiment, the gradations after being converted are "($R_2$, $G_2$, $B_2$, $W_2$)=(183, 90, 143, 183)", respectively.

Figure 7:
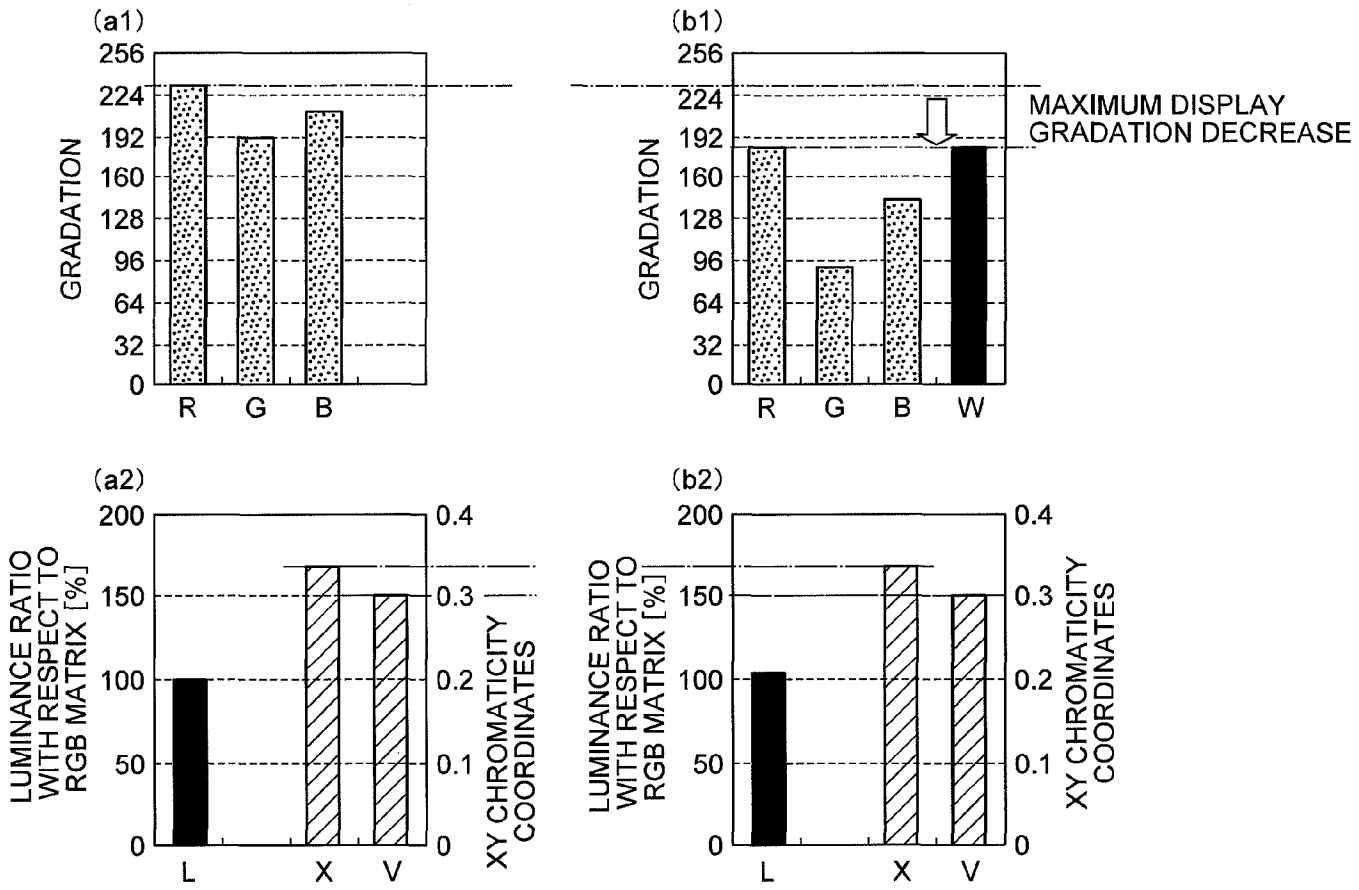
FIG. 7 shows graphs illustrating input values and output values of video signals of the RGBW converting part shown in FIG. 1.

FIG. 7 shows graphs which illustrate input values and output values of video signals by the RGBW converting part 22 shown in FIG. 1. FIG. 7(*a*1) shows the gradation of the input signal, FIG. 7(*a*2) shows the luminance of the input signal (luminance ratio with respect to the RGB matrix) and the chromaticity (XY chromaticity coordinates), FIG. 7(*b*1) shows the luminance and the chromaticity of the output signal, respectively.

Comparing the gradations before and after the conversion in FIG. 7(*a*1)) and FIG. 7(*b*1), the maximum gradation is 230 since the gradations of the input signal are (R, G, B)=(230, 190, 210). However, the maximum gradation of the output signal is reduced to 183 since the gradations of the output signal are ($R_2$, $G_2$, $B_2$, $W_2$)=(183, 90, 143, 183). In the meantime, comparing the luminance and the chromaticity before and after the conversion in FIG. 7(*a*2) and FIG. 7(*b*2), it can be found that the XY chromaticity coordinates of the chromaticity therein are the same, and there is only a small change in the values of the luminance.

The first sub-frame output gradation values can be obtained as (251, 123, 196, 251) and the second sub-frame gradation values as (0, 0, 0, 0) by utilizing the first sub-frame LUT 24*a* and the second sub-frame LUT 24*b* shown in FIG. 5. In this exemplary embodiment, the gradation of the first sub-frame is taken as the maximum value for the gradation larger than 186, and the gradation of the second sub-frame is taken as the minimum value for the gradation smaller than 186.

When the input video signals are converted to the output gradations of the first and second sub-frames by the LUT without performing color conversion by the RGBW converting part 22, the output gradations of RGB of the first sub-frame all become the maximum values, while the gradations of the second sub-frame do not become the minimum values, i.e., the gradations become (201, 63, 1, 49), which are relatively large halftones. Therefore, a sufficient moving picture quality cannot be obtained, and a motion blur phenomenon occurs.

In the meantime, in this exemplary embodiment, the gradation is replaced to the low-gradation side by the color conversion. Therefore, a large difference can be generated between the output gradations of the first sub-frame and the second sub-frame, so that the motion blur can be prevented and the moving picture quality can be improved.

The RGBW converting part 22 of this exemplary embodiment may need to change the maximum values of the output gradations of RGBW to be smaller with respect to the maximum values of the input gradations of RGB through the conversion of RGBW. While the RGBW conversion method which emphasizes on the chromaticity coordinates and the continuities of the luminance and chromaticity has been described above, it is also possible to employ a conversion method which emphasizes on increases of the luminance, a conversion method which emphasizes on consistency of the chromaticity coordinates, etc. Further, it is not limited to divide one frame into two sub-frames (the first sub-frame and the second sub-frame) but may be divided into a large number of sub-frames.

Figure 8A:
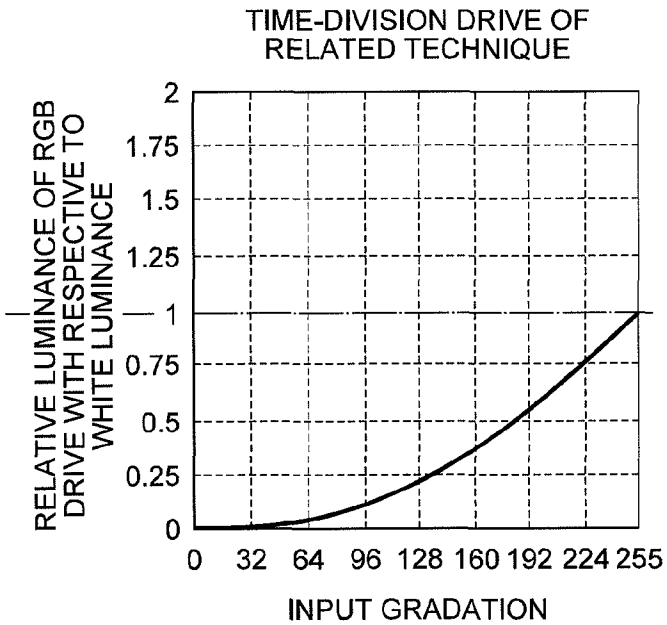
FIG. 8A is a graph illustrating corresponding relations between the input signals and the relative luminance in a case of time-division drive according to a related technique.
Figure 8B:
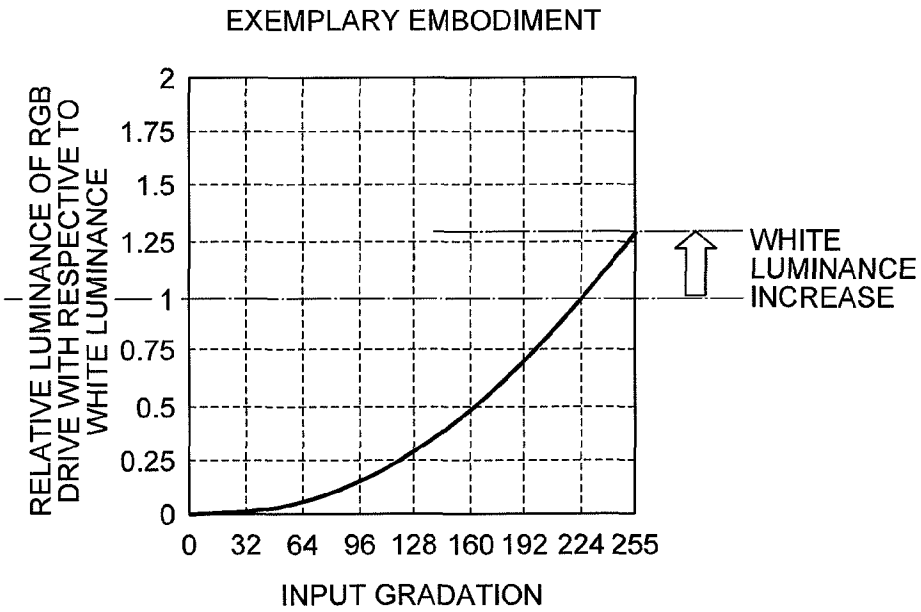
FIG. 8B is a graph illustrating corresponding relations between the input signals and the relative luminance in a case of the liquid crystal display device according to the exemplary embodiment in FIG. 1-FIG. 7.
Figure 20A:
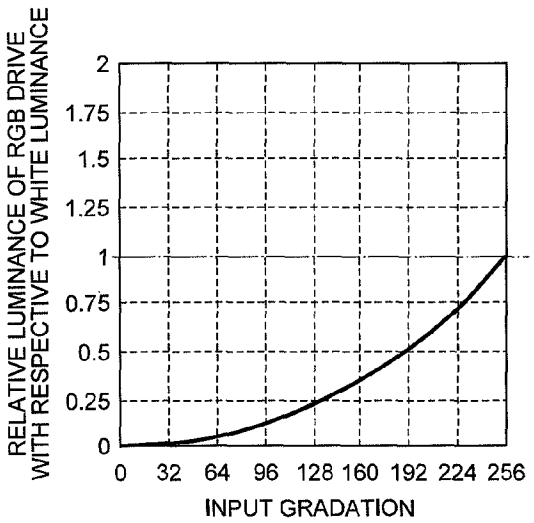
FIG. 20A is a graph illustrating corresponding relations between the input signals and the relative luminance in a case of the normal drive mode shown in FIG. 19.
Figure 20B:
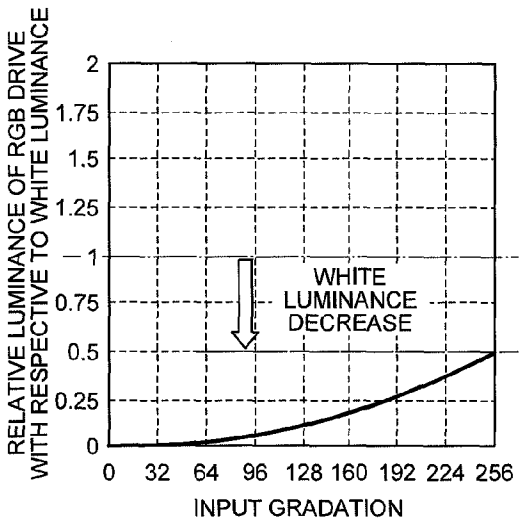
FIG. 20B is a graph illustrating corresponding relations between the input signals and the relative luminance in a case of the black insertion drive mode shown in FIG. 19.
Figure 20C:
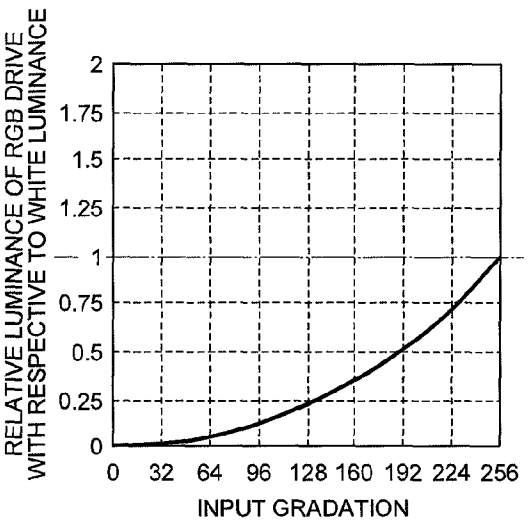

FIG. 8 shows graphs which illustrate corresponding relations between the input signals and the relative luminance in a case of time-division drive according to a related technique and a case of the liquid crystal display device 1 according to the exemplary embodiment shown in FIG. 1-FIG. 7. FIG. 8(*a*) is a graph of a case of time-division drive, which is the same as the case shown in FIG. 20(*c*), while FIG. 8(*b*) is a graph showing the case of this exemplary embodiment. In both graphs, the lateral axis is the gradation of the input signal, and the vertical axis is the relative luminance with respect to a white screen. As in the above-described case, it is assumed that the input signal is the video signal (R, G, B)=(230, 190, 210), and each of the parameters is A=1.3, $\alpha$=0.75, the resolution N of the input signal is 8 (bits), and $\gamma$=2.2.

As shown in FIG. 8(*b*), the maximum value of the white luminance is improved with this exemplary embodiment. Further, as shown in FIG. 7, the maximum display gradations is lowered from 230 to 183 while the XY chromaticity coordinates of the chromaticity are remained as the same. Therefore, it is possible to display the same contents with the low-gradation input signals with which the effect of suppressing the motion blur in the time-division drive can be improved. For example, in order to obtain the relative luminance of 1.0, it is necessary to input 256 for the input gradation with the time-division drive of the related technique shown in FIG. 8(*a*), whereas required is 226 for the case of the exemplary embodiment shown in FIG. 8(*b*).

As described, with the first exemplary embodiment of the present invention, it is possible to improve the white luminance through inserting the W sub-pixels having high transmittance and to increase the moving picture improving effect in the dime-division display at the same time through converting the same video display to the low-gradation input signals. This makes it possible to achieve a high image quality display device with which improvements of the luminance efficiency and suppression of the motion blur can both be achieved.

The cases shown in FIG. 7-FIG. 8 are examples where the RGBW luminance efficiency $\alpha$ is set as 0.75. However, the RGBW luminance efficiency may be set by considering the luminance and the motion blur according to the usages. For example, when it is set as close to $\alpha$=1.0, the luminance improving effect can be increased even though the effect of suppressing the motion blur is lowered since the decrease amount of the display gradation is reduced. Inversely, when $\alpha$ is set small, the effect of suppressing the motion blur can be increased since the decrease amount of the display gradation is increased even though the luminance improving effect is decreased.

Figure 9:
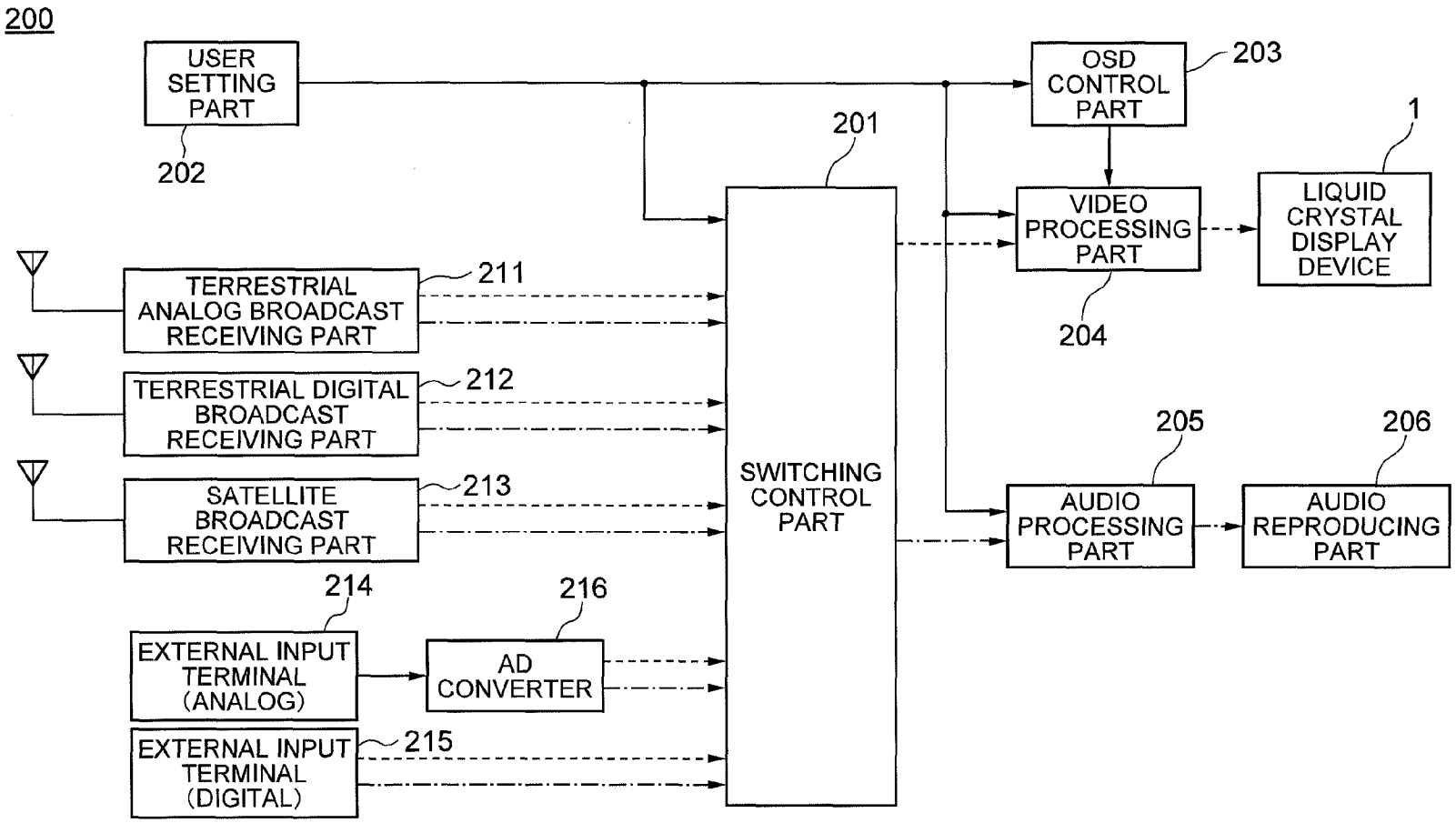
FIG. 9 is a block diagram showing a structure of a broadcast receiving device to which the liquid crystal display device according to the exemplary embodiment shown in FIG. 1

FIG. 9 is a block diagram showing a structure of a broadcast receiving device 200 to which the liquid crystal display device according to the exemplary embodiment shown in FIG. 1-FIG. 8 is applied. The broadcast receiving device includes a switching control part 201, a user setting part 202, an OSD (on-screen display) control part 203, a video processing part 204, an audio processing part 205, an audio reproducing part 206, and the liquid crystal display device 1. In FIG. 9, video signals are shown with broken lines, audio signals are shown with alternate long and short dash lines, and other signals are shown with solid lines.

The switching control part 201 switches the video signals and the audio signals inputted from a plurality of video sources based on the input from the user setting part 202, and outputs those signals to the video processing part 204 and the audio processing part 205, respectively. Further, the OSD control part 203 forms an image for supporting the user setting, and outputs it to the video processing part 204.

The video processing part 204 performs IP conversion, format conversion with scaler or the like, and video adjustments such as brightness, contrast, color, and the like on the video signal selected by the switching control part 201. At the same time, the video processing part 204 synthesizes user setting images inputted from the OSD control part, and inputs it to the liquid crystal display device 1. The audio processing part 205 performs processing such as analog conversion on the audio signal that is selected by the switching control part 201 to audio signals that can be reproduced by the audio reproducing part 206, and inputs it to the audio reproducing part 206. The audio reproducing part 206 is for reproducing the audio signals inputted by the audio processing part 205, which includes a speaker, an amplifier, and the like.

Further, the broadcast receiving device 200 can include a single or a plurality of video source(s) as necessary. Specifically, the broadcast receiving device 200 can have built-in video sources such as a terrestrial analog broadcast receiving part 211, a terrestrial digital broadcast receiving part 212, a satellite broadcast receiving part 213, and the like. Further, it is possible to receive input of external video sources via an analog input terminal 214 and a digital input terminal 215. Analog video signals received via the analog input terminal 214 are converted to digital video signals by an A/D converter 216.

However, the liquid crystal display device 1 is not limited to be applied only to such broadcast receiving device 200. For example, the liquid crystal display device can be applied to all kinds of electronic apparatuses that utilize the liquid crystal device, such as computer devices, portable telephone terminals, digital cameras, game machines, music players, and the like. Further, the present invention can also be applied to a hold-type display device other than the liquid crystal display device and to all kinds of electronic apparatuses which utilize such device. Furthermore, the structure of the broadcast receiving device 200 is not limited to the case shown in FIG. 9. The broadcast receiving device 200 may have a different functional block structure from that of FIG. 9, may include video sources other than those shown in FIG. 9, or may only include an input terminal from outside, without having any video source at all.

The present invention is structured to convert the video signal of the three primary colors to the video signal of four or more colors including the compound color. Therefore, as an exemplary advantage according to the invention, it is possible to display the same video with the signals of lower gradation than the gradation used in the three-primary color display, and to achieve the effect of suppressing the generation of motion blur in the time-division drive. This makes it possible to have a fine luminance efficiency, while suppressing the generation of the motion blur in the image display device.

Second Exemplary Embodiment

Figure 10:
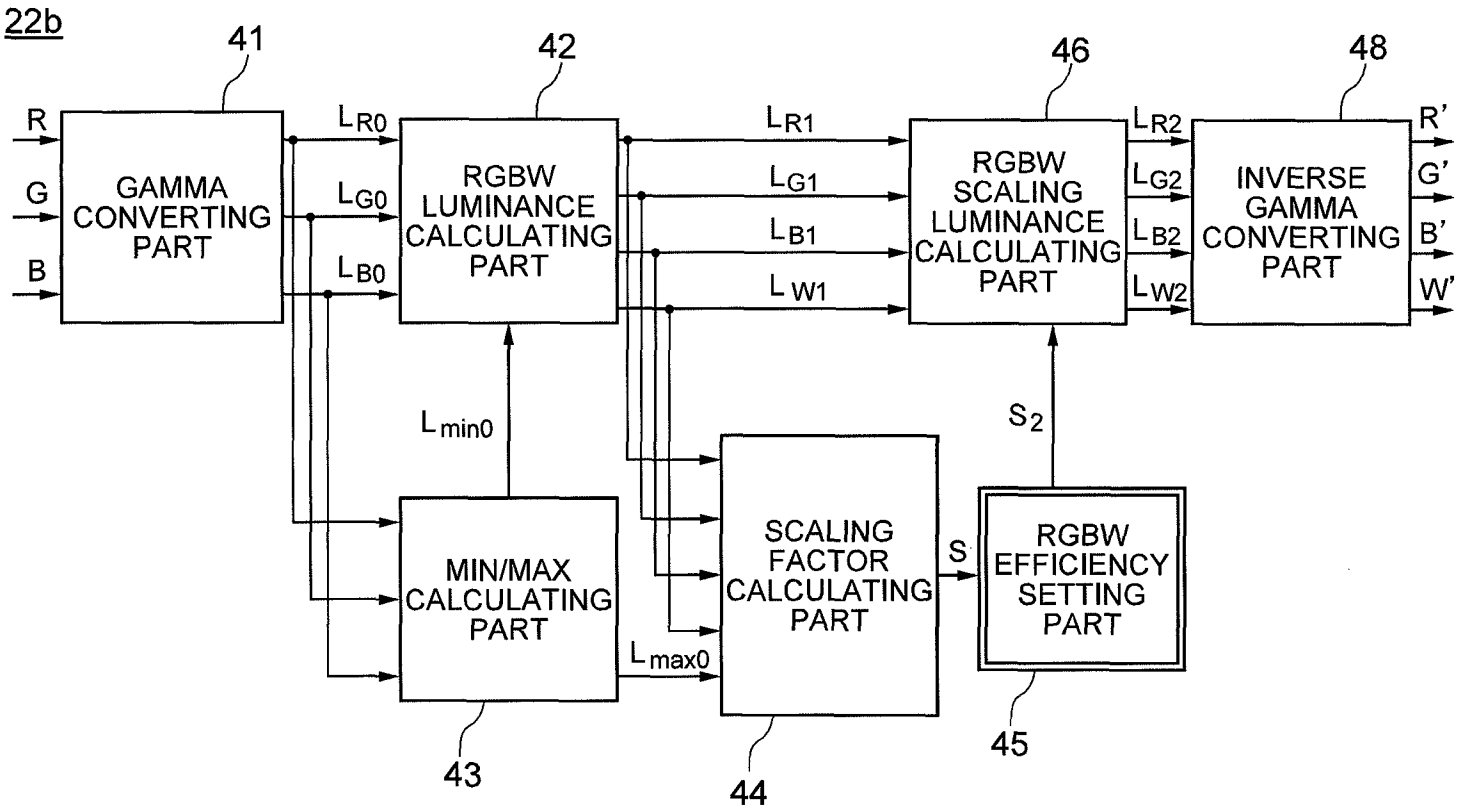
FIG. 10 is a block diagram showing a structure of an RGBW converting part of a liquid crystal display device according to a second exemplary embodiment of the present invention.

FIG. 10 is a block diagram showing a structure of an RGBW converting part 22*b* of a liquid crystal display device according to a second exemplary embodiment of the present invention. In the liquid crystal display device according to the second exemplary embodiment of the present invention, the low-luminance processing part 47 of the liquid crystal display device 1 according to the first exemplary embodiment shown in FIG. 3 is omitted, and the scaling relative luminance ($L_{R2}$, $L_{G2}$, $L_{B2}$, $L_{W2}$) outputted from the RGBW scaling luminance calculating part 46 is inputted to the inverse gamma converting part 48. Other structures are the same as those of the first exemplary embodiment, so that further explanations will be omitted.

Figure 11:
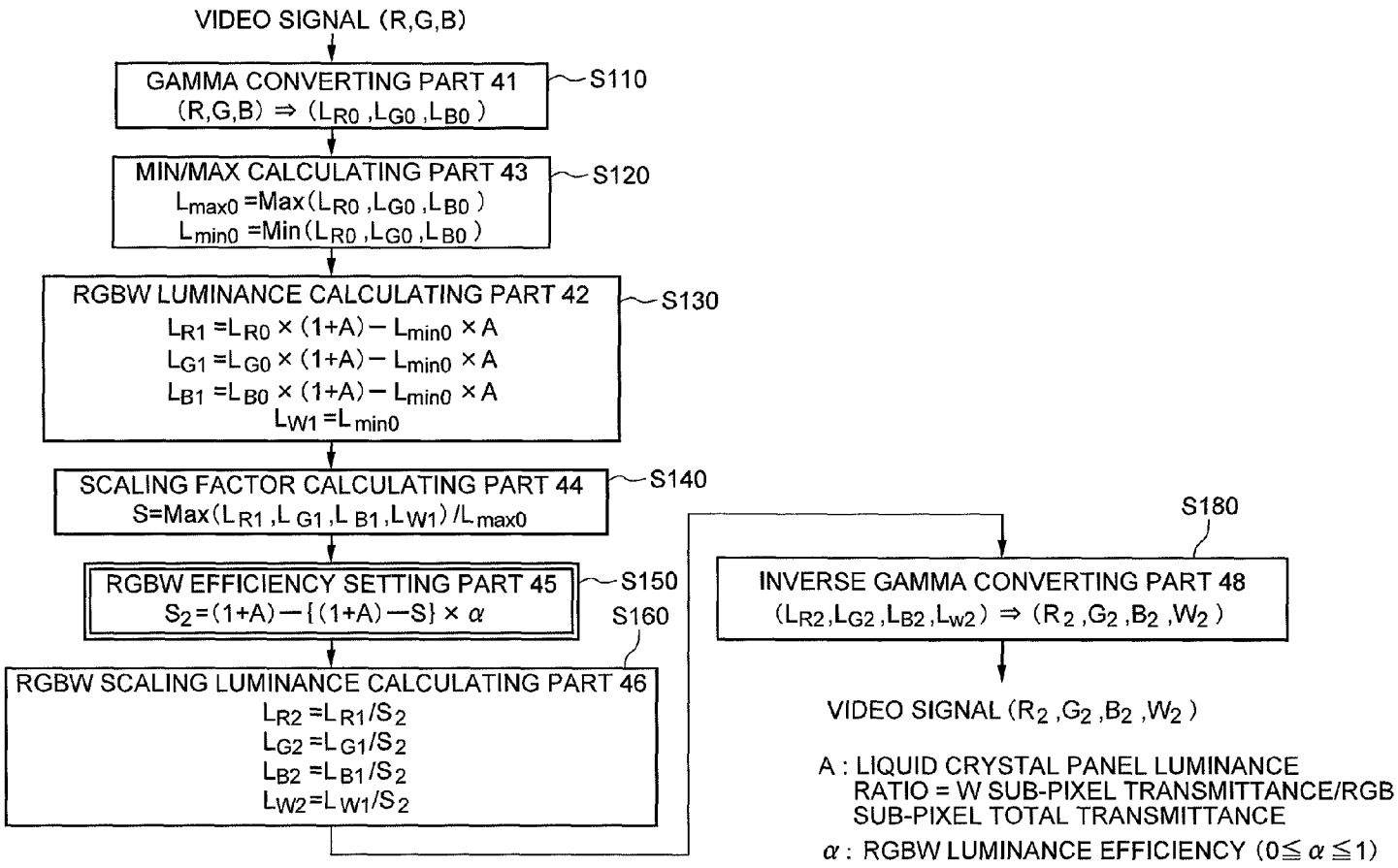
FIG. 11 is a flowchart showing operations of the RGBW converting part shown in FIG. 10.

FIG. 11 is a flowchart showing operations of the RGBW converting part 22*b* shown in FIG. 10. In the processing shown in FIG. 11, the processing (steps S171-174) performed by the low-luminance processing part 47 is omitted compared to the flowchart of FIG. 4 which shows the operations of the RGBW converting part 22 according to the first exemplary embodiment.

The inverse gamma converting part 48 performs processing for converting the scaling relative luminance ($L_{B2}$, $L_{G2}$, $L_{B2}$, $L_{W2}$) outputted from the RGBW scaling luminance calculating part 46 to the low-gradation processed RGBW gradation values ($R_2$, $G_2$, $B_2$, $W_2$) (step S180). The processing contents are completely the same except that $L_{R3}$, $L_{G3}$, $L_{B3}$, $L_{W3}$ shown in Expression 11 are replaced with $L_{R2}$, $L_{G2}$, $L_{B2}$, $L_{W2}$, respectively. Other than this, there is no more difference with respect to the processing shown in FIG. 4. Thus, further explanations regarding the operations will be omitted.

Figure 12:
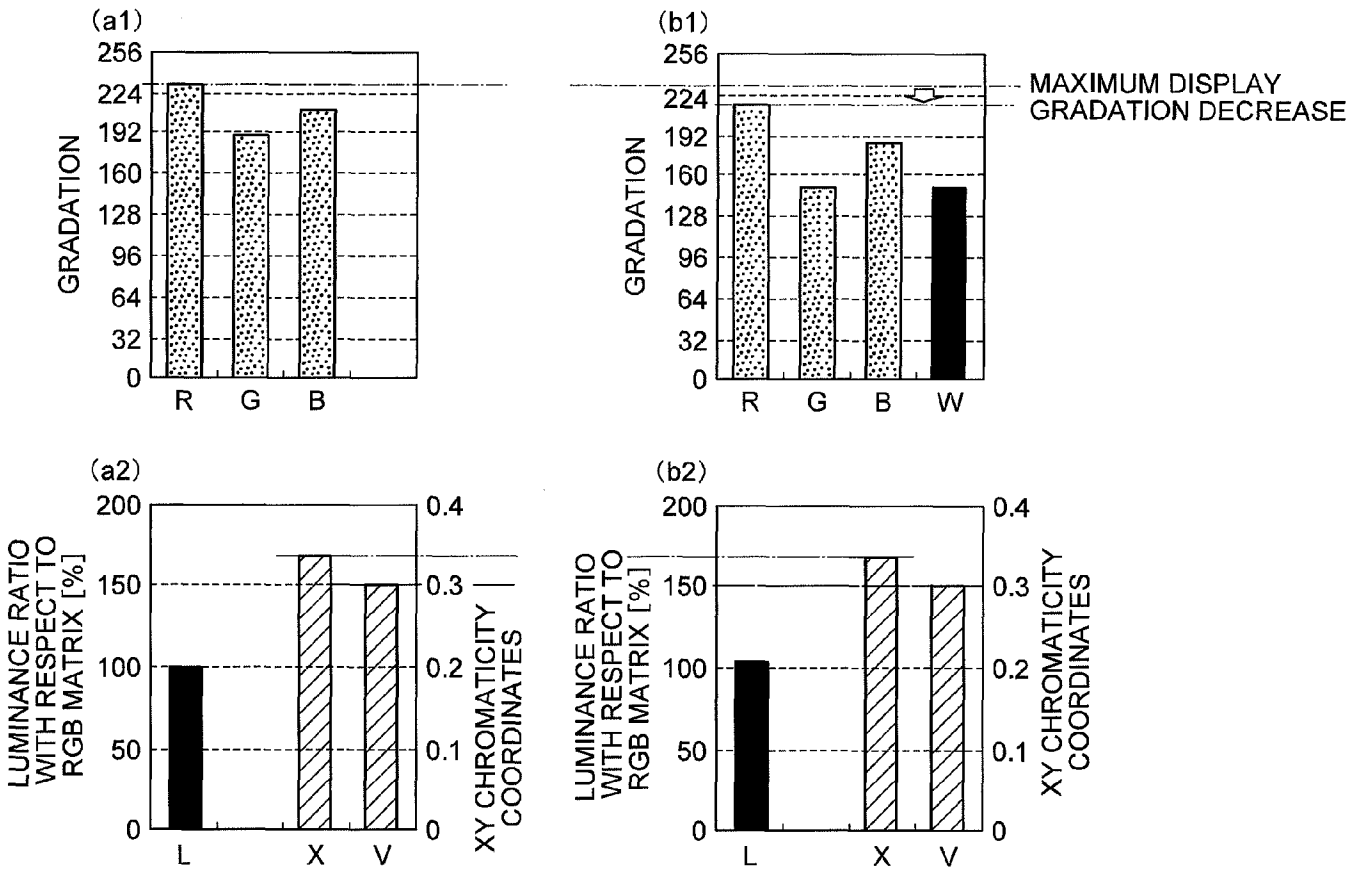
FIG. 12 shows graphs illustrating input values and output values of video signals of the RGBW converting part shown in FIG. 10.
Figure 13A:
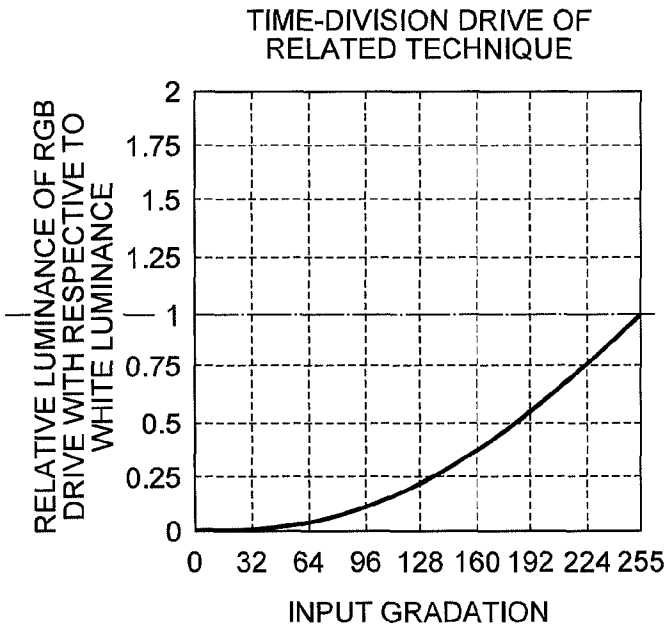
FIG. 13A is a graph illustrating corresponding relations between the input signals and the relative luminance in a case of time-division drive according to a related technique.
Figure 13B:
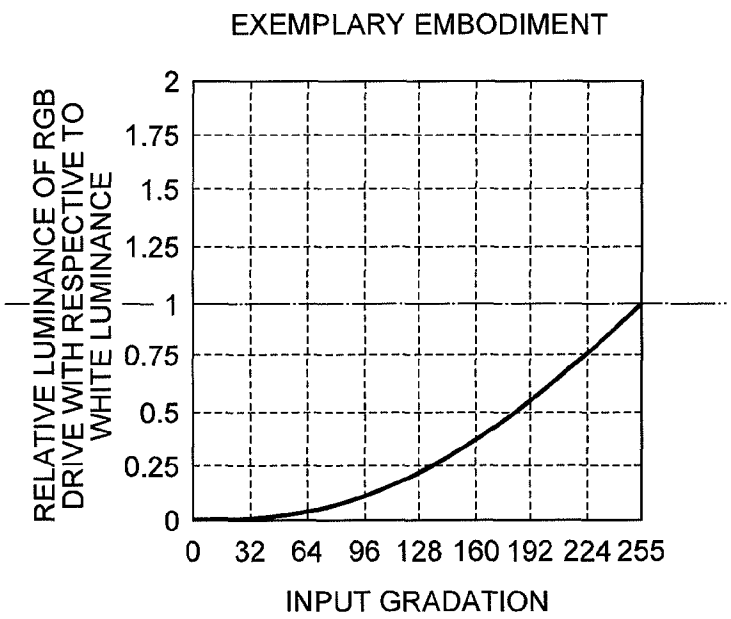
FIG. 13B is a graph illustrating corresponding relations between the input signals and the relative luminance in a case of the liquid crystal display device according to the exemplary embodiment shown in FIG. 10-FIG. 12.

FIG. 12 shows graphs which illustrate input values and output values of video signals of the RGBW converting part 22*b* shown in FIG. 10. FIG. 13 shows graphs which illustrate corresponding relations between the input signals and the relative luminance in a case of time-division drive according to a related technique and a case of the liquid crystal display device according to the exemplary embodiment shown in FIG. 10-FIG. 12. It can be seen that the effect of reducing the maximum gradation is achieved, even though the extent thereof is decreased compared to the case of the first exemplary embodiment shown in FIG. 7 and FIG. 8.

Moreover, the operations of the RGBW converting part 22*b* can be achieved by a smaller arithmetic operation amount compared to that of the RGBW converting part 22 of the first exemplary embodiment, since the low-luminance processing part 47 is omitted. Thus, required therein is only hardware of still smaller calculation capability. Therefore, it is possible to achieve the effect of suppressing the motion blur, while decreasing the cost for the display device.

In the graphs shown in FIG. 12 and FIG. 13, the RGBW luminance efficiency $\alpha$ is so set that the white luminance becomes equivalent to that of the case of time-division drive (the case of this exemplary embodiment: $\alpha$=0.44). In the case of this exemplary embodiment, it is possible to set the RGBW luminance efficiency $\alpha$ by considering the luminance and the motion blur according to the usages.

Third Exemplary Embodiment

Figure 14:
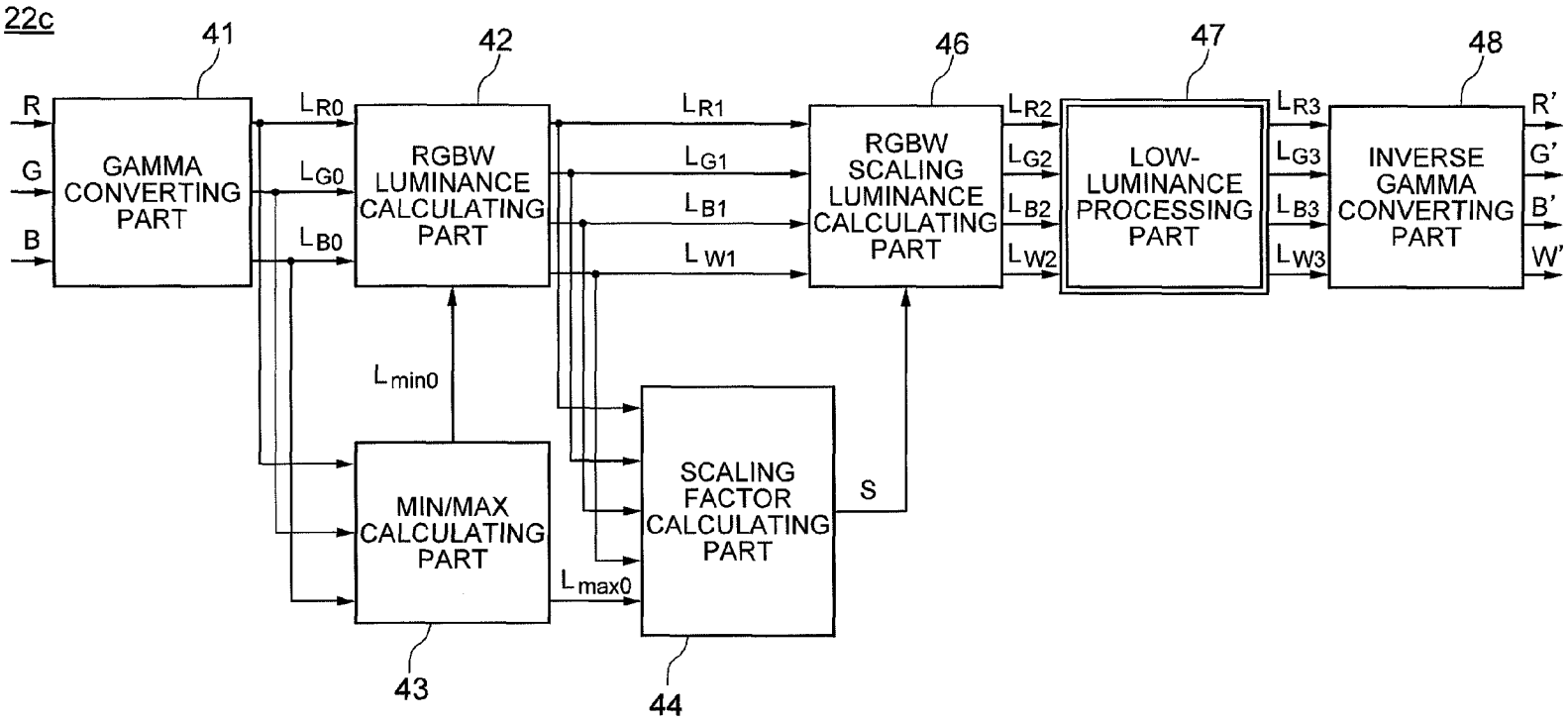
FIG. 14 is a block diagram showing a structure of an RGBW converting part of a liquid crystal display device according to a third exemplary embodiment of the present invention.

FIG. 14 is a block diagram showing a structure of an RGBW converting part 22*c* of a liquid crystal display device according to a third exemplary embodiment of the present invention. In the liquid crystal display device according to the third exemplary embodiment of the present invention, the RGBW efficiency setting part 45 of the liquid crystal display device 1 according to the first exemplary embodiment shown in FIG. 3 is omitted, and the scaling factor S outputted from the scaling factor calculating part 44 is inputted to the RGBW scaling luminance calculating part 46. Other structures are the same as those of the first exemplary embodiment, so that further explanations will be omitted.

Figure 15:
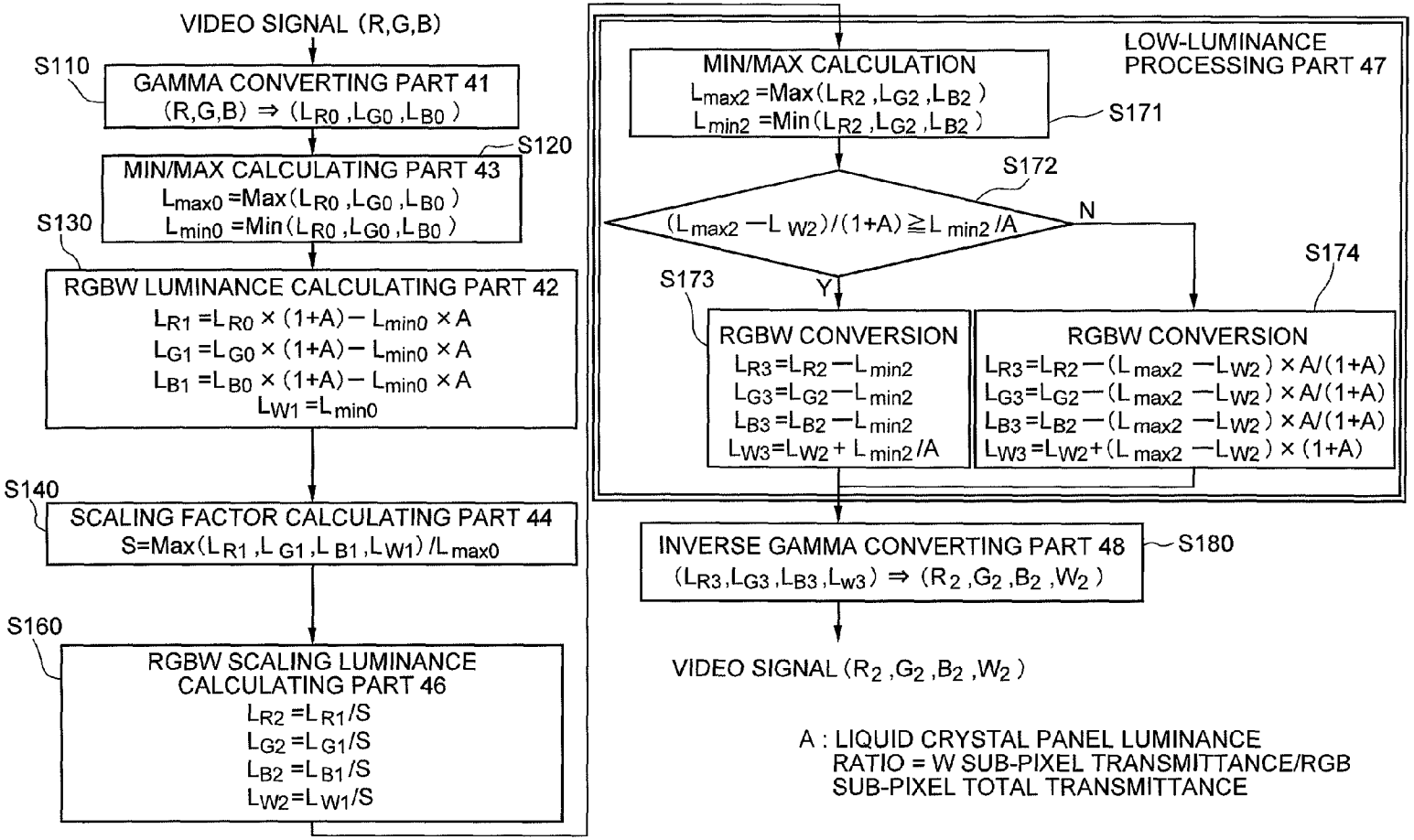
FIG. 15 is a flowchart showing operations of the RGBW converting part shown in FIG. 14.

FIG. 15 is a flowchart showing operations of the RGBW converting part 22*c* shown in FIG. 14. In the processing shown in FIG. 15, the processing (steps S150) performed by the RGBW efficiency setting part 45 is omitted compared to the flowchart of FIG. 4 which shows the operations of the RGBW converting part 22 according to the first exemplary embodiment. The contents of the processing (step S160) performed by the RGBW scaling luminance calculating part 45 are completely the same except that $S_2$ shown in Expression 6 is replaced with S. Other than this, there is no more difference with respect to the processing shown in FIG. 4. Thus, further explanations regarding the operations will be omitted.

Figure 16:
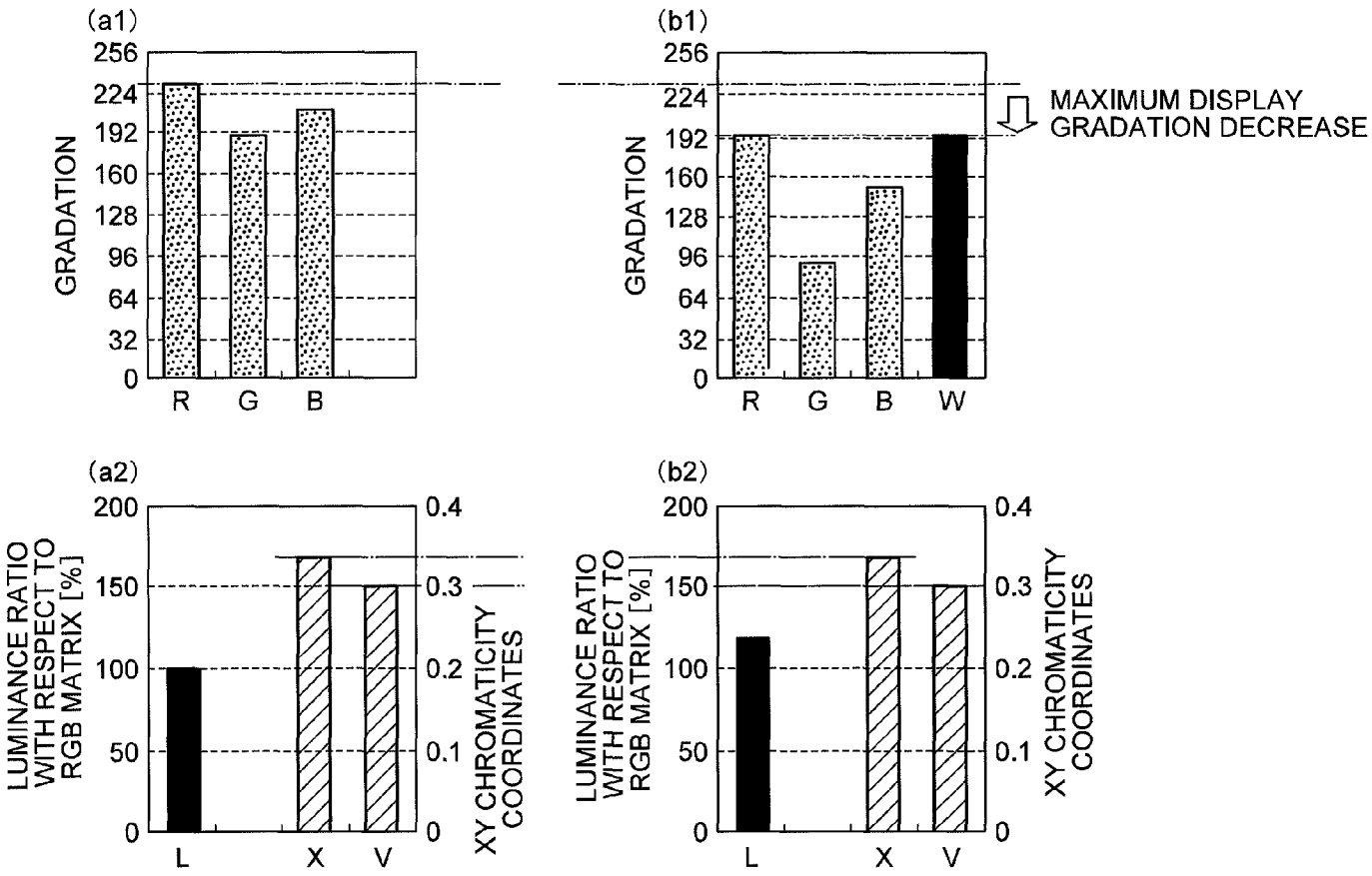
FIG. 16 shows graphs illustrating input values and output values of video signals of the RGBW converting part shown in FIG. 14.
Figure 17A:
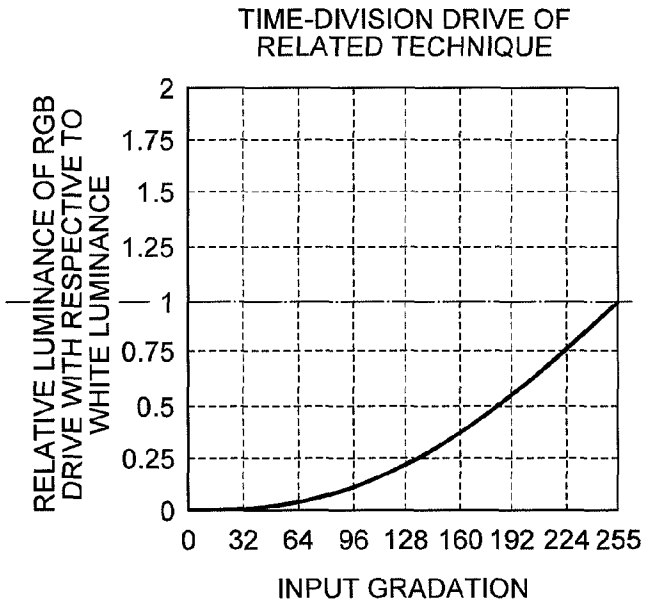
FIG. 17A is a graph illustrating corresponding relations between the input signals and the relative luminance in a case of time-division drive according to a related technique.
Figure 17B:
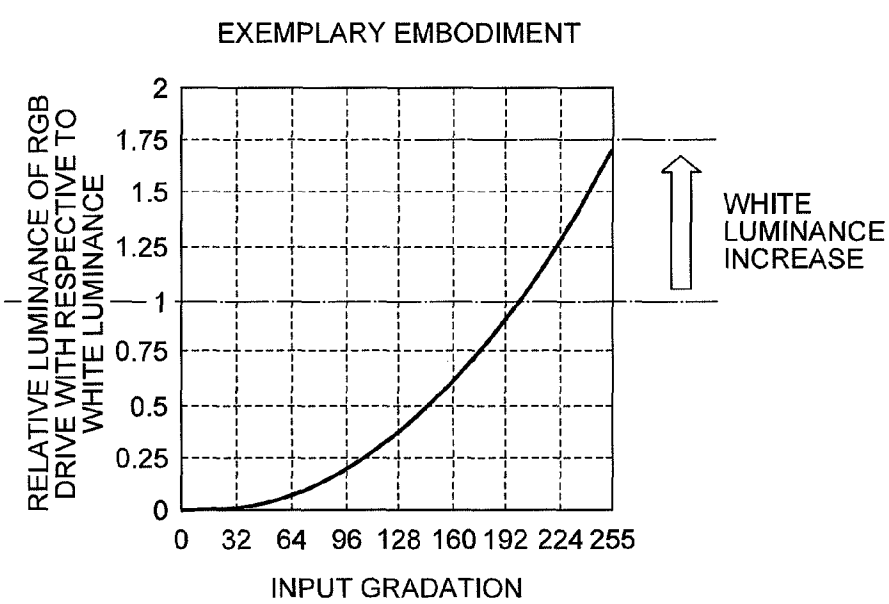
FIG. 17B is a graph illustrating corresponding relations between the input signals and the relative luminance in a case of the liquid crystal display device according to the exemplary embodiment shown in FIG. 14-FIG. 16.

FIG. 16 shows graphs which illustrate input values and output values of video signals of the RGBW converting part 22*c* shown in FIG. 14. FIG. 17 shows graphs which illustrate corresponding relations between the input signals and the relative luminance in a case of time-division drive according to a related technique and a case of the liquid crystal display device according to the exemplary embodiment shown in FIG. 14-FIG. 16. It can be seen that the effect of reducing the maximum gradation is achieved, even though the extent thereof is decreased compared to the case of the first exemplary embodiment shown in FIG. 7 and FIG. 8. Furthermore, it can be seen that the white luminance is more improved compared to the case of the first exemplary embodiment. Since the RGBW efficiency setting part 45 is omitted, it is possible with this exemplary embodiment to achieve the effect of suppressing the motion blur while decreasing the cost for the display device, as in the case of the second exemplary embodiment.

Fourth Exemplary Embodiment

Figure 18:
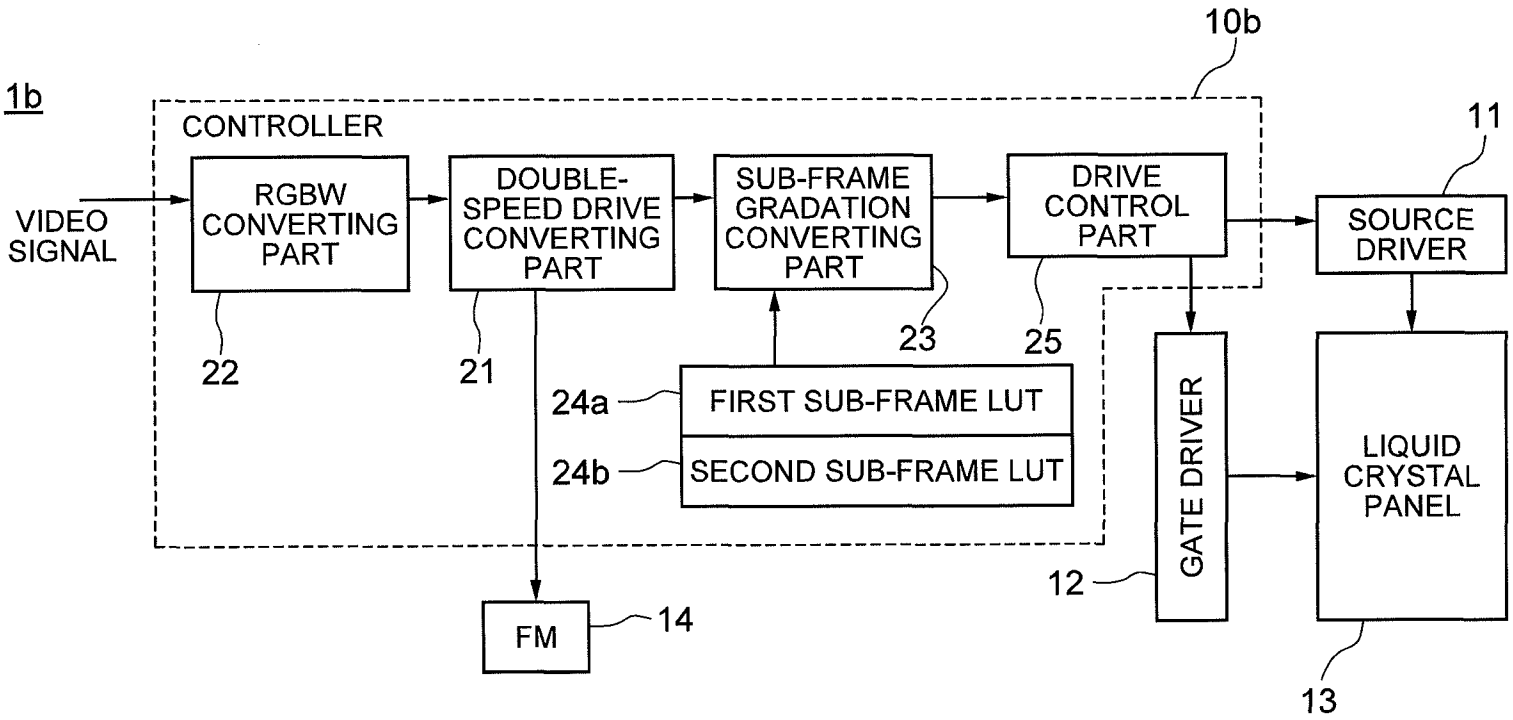
FIG. 18 is a block diagram showing a structure of a liquid crystal display device according to a fourth exemplary embodiment of the present invention.
Figure 19:
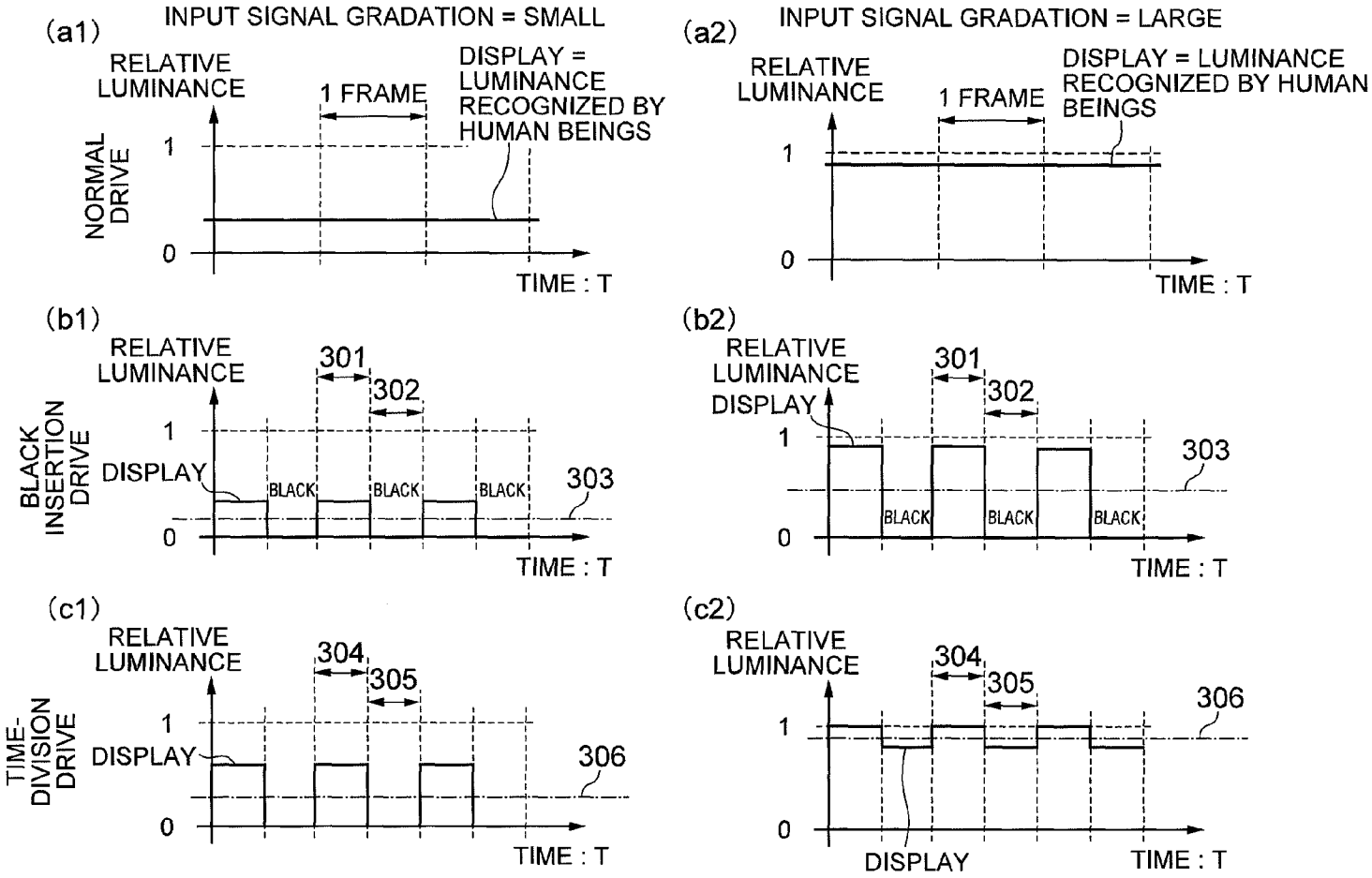
FIG. 19 shows time charts showing changes in the relative luminance of signals inputted to a hold-type display device such as a liquid crystal display device of a related technique with respect to the time base.

FIG. 18 is a block diagram showing a structure of a liquid crystal display device 1*b* according to a fourth exemplary embodiment of the present invention. A controller 10*b* of the liquid crystal display device 1*b* performs processing in such a manner that video signals inputted from outside are first converted to RGBW by an RGBW converting part 22 so that the maximum gradation becomes smaller. Thereafter, a double-speed drive converting part 21 converts the video signal outputted from the RGBW converting part 22 to a first sub-frame and a second sub-frame, and transmits those to a sub-frame gradation converting part 23. Other structures are the same as those of the liquid crystal display device according to the first exemplary embodiment of the present invention, so that further explanations will be omitted.

The contents of the processing performed by the RGBW converting part 22 and the double-speed drive converting part 21 are the same as those of the first exemplary embodiment, and the effects obtained thereby are the same as those of the first exemplary embodiment. With such structure, the amount of screen data saved by the double-speed drive converting part 21 in the frame memory 14 is increased. However, the arithmetic operation amount performed by the RGBW converting part 22 can be reduced to half. This also leads to reduction of the cost for the display device. The RGBW converting part 22 may be replaced with the RGBW converting part 22*b* or the RGBW converting part 22*c* described in the second and third exemplary embodiments.

While the present invention has been described by referring to specific exemplary embodiments shown in the accompanying drawings, the present invention is not limited only to those exemplary embodiments illustrated in the drawings. It is needless to say that any of known structures can be employed therewith as long as the effects of the present invention can be achieved.

INDUSTRIAL APPLICABILITY

The present invention can be applied to all kinds of electronic apparatuses which utilizes a hold-type display device such as a liquid crystal display device.

What is claimed is:

1. A controller for adjusting a signal outputted to a hold-type image display panel, comprising:

a video signal converting part having a double-speed drive conversion function which divides one frame of a video signal to a plurality of sub-frames, a color conversion function which converts a video signal of three primary colors to a video signal of four or more colors including the three primary colors and a compound color, and a gradation comparing function which compares a value representing a video signal of the three primary colors excluding the compound color from the video signal of the four or more colors, with a value representing a video signal of the compound color from the video signal of the four or more colors; and a sub-frame converting part which converts, the video signal converted by the video signal converting part, to a signal having a plurality of different gradations whose average luminance value becomes equivalent to luminance of the video signal converted by the color converting part, and takes each of the plurality of gradations as each of gradations of the plurality of sub-frames, wherein the video signal converting part comprises:

a double-speed drive converting part which executes the double-speed drive conversion function for the inputted video signal;

wherein the video signal converting part has the color conversion function for the video signal that is divided into the plurality of sub-frames by the double-speed drive converting part, the color conversion function being performed in such a manner that:

a maximum gradation of the video signal of the four or more colors becomes smaller than a maximum gradation of the video signal of the three primary colors, the gradation of one of the four colors of the video signal other than the compound color becomes 0-gradation or the maximum gradation of the colors other than the compound color becomes equivalent to the gradation of the compound color, and a chromaticity coordinate of the video signal of four or more colors is the same as a chromaticity coordinate of the video signal of the three primary colors, and wherein the sub-frame converting part makes the gradation of one of the plurality of sub-frames to a gradation close to a minimum value when the inputted video signal is of a gradation smaller than a prescribed gradation, and makes the gradation of one of the plurality of sub-frames to a gradation close to a maximum value when the inputted video signal is of a gradation larger than the prescribed gradation, wherein the color conversion function comprises:

a scaling factor calculating part which calculates a scaling factor from the maximum gradation of the video signal of the three primary colors and the gradation of the video signal of the four or more colors; and a scaling luminance setting part which calculates scaling relative luminance from relative luminance of the video signal of the four or more colors and the scaling factor, wherein the scaling factor is calculated according to an area ratio of the pixels of the compound color with respect to an area ratio of the pixels of the three primary colors.

2. A controller for adjusting a signal outputted to a hold-type image display panel, comprising:

a video signal converting part having a double-speed drive conversion function which divides one frame of a video signal to a plurality of sub-frames, a color conversion function which converts a video signal of three primary colors to a video signal of four or more colors including the three primary colors and a compound color, and a gradation comparing function which compares a value representing a video signal of the three primary colors excluding the compound color from the video signal of the four or more colors, with a value representing a video signal of the compound color from the video signal of the four or more colors; and a sub-frame converting part which converts, the video signal converted by the video signal converting part, to a signal having a plurality of different gradations whose average luminance value becomes equivalent to luminance of the video signal converted by the color converting part, and takes each of the plurality of gradations as each of gradations of the plurality of sub-frames, wherein the video signal converting part has the color conversion function, the color conversion function being performed in such a manner that:

a maximum gradation of the video signal of the four or more colors becomes smaller than a maximum gradation of the video signal of the three primary colors, the gradation of one of the four colors of the video signal other than the compound color becomes 0-gradation or the maximum gradation of the colors other than the compound color becomes equivalent to the gradation of the compound color, and a chromaticity coordinate of the video signal of four or more colors in the same as a chromaticity coordinate of the video signal of the three primary colors, wherein the video signal converting part comprises a double-speed drive converting part which executes the double-speed drive conversion function for the video signal converted by the color converting part, and wherein the sub-frame converting part makes the gradation of one of the plurality of sub-frames to a gradation close to a minimum value when the inputted video signal is of a gradation smaller than a prescribed gradation, and makes the gradation of one of the plurality of sub-frames to a gradation close to a maximum value when the inputted video signal is of a gradation larger than the prescribed gradation, wherein the color conversion function comprises:

a scaling factor calculating part which calculates a scaling factor from the maximum gradation of the video signal of the three primary colors and the gradation of the video signal of the four or more colors; and a scaling luminance setting part which calculates scaling relative luminance from relative luminance of the video signal of the four or more colors and the scaling factor, wherein the scaling factor is calculated according to an area ratio of the pixels of the compound color with respect to an area ratio of the pixels of the three primary colors.

* * * * *